US008750761B2

(12) United States Patent
Nagamori et al.

(10) Patent No.: US 8,750,761 B2
(45) Date of Patent: Jun. 10, 2014

(54) CHARGING DEVICE, IMAGE FORMING APPARATUS, AND POTENTIAL CONTROL PLATE

(75) Inventors: Yuki Nagamori, Kanagawa (JP); Koji Otsuka, Kanagawa (JP); Kuniaki Tanaka, Kanagawa (JP); Arichika Tanaka, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 387 days.

(21) Appl. No.: 13/238,628

(22) Filed: Sep. 21, 2011

(65) Prior Publication Data

US 2012/0251180 A1 Oct. 4, 2012

(30) Foreign Application Priority Data

Mar. 28, 2011 (JP) ..... 2011-070889

(51) Int. Cl.
*G03G 15/02* (2006.01)

(52) U.S. Cl.
CPC ..... *G03G 15/0291* (2013.01)
USPC ..... 399/171

(58) Field of Classification Search
CPC ..... G03G 15/02; G03G 15/0258; G03G 15/0291; G03G 2215/026; G03G 2215/027
USPC ..... 399/100, 170, 171; 250/324–326
See application file for complete search history.

(56) References Cited

U.S. PATENT DOCUMENTS

| | | | | |
|---|---|---|---|---|
| 6,246,852 | B1 * | 6/2001 | Branch et al. | 399/171 |
| 6,823,157 | B2 * | 11/2004 | Foltz | 399/171 |
| 6,963,708 | B2 * | 11/2005 | Sekovski et al. | 399/171 |
| 7,212,771 | B2 * | 5/2007 | Tanaka et | 399/171 |
| 7,272,337 | B2 * | 9/2007 | Owens | 399/100 |
| 7,885,578 | B2 | 2/2011 | Yoshino | |

* cited by examiner

*Primary Examiner* — William J Royer
(74) *Attorney, Agent, or Firm* — Oliff PLC

(57) ABSTRACT

A charging device includes a discharge electrode that extends along an axial direction of a member to be charged; and a potential control plate disposed between the member to be charged and the discharge electrode and curved along a peripheral surface of the member to be charged. The potential control plate includes three or more structural lines that are arranged in a circumferential direction of the member to be charged and that linearly extend along the axial direction, and connecting portions arranged in the axial direction, each connecting portion connecting two or more of the three or more structural lines to each other, the two or more structural lines being next to each other in the circumferential direction. The structural lines connected by one of the connecting portions and those connected by another one of the connecting portions are at least partly different from each other.

10 Claims, 17 Drawing Sheets

CHARGING DEVICE, IMAGE FORMING APPARATUS, AND POTENTIAL CONTROL PLATE

CROSS-REFERENCE TO RELATED APPLICATIONS

This application is based on and claims priority under 35 USC 119 from Japanese Patent Application No. 2011-070889 filed Mar. 28, 2011.

BACKGROUND

The present invention relates to a charging device, an image forming apparatus, and a potential control plate.

SUMMARY

According to an aspect of the invention, there is provided a charging device including a discharge electrode that extends along an axial direction of a member to be charged, the member to be charged having a cylindrical shape or a columnar shape; and a potential control plate that is disposed between the member to be charged and the discharge electrode and curved along a peripheral surface of the member to be charged. The potential control plate includes three or more structural lines that are arranged in a circumferential direction of the member to be charged and that linearly extend along the axial direction of the member to be charged, and plural connecting portions that are arranged in the axial direction of the member to be charged, each connecting portion connecting two or more of the three or more structural lines to each other, the two or more structural lines being next to each other in the circumferential direction of the member to be charged. The structural lines connected by one of the plural connecting portions and the structural lines connected by another one of the plural connecting portions are at least partly different from each other.

BRIEF DESCRIPTION OF THE DRAWINGS

An exemplary embodiment of the present invention will be described in detail based on the following figures, wherein.

DETAILED DESCRIPTION

An exemplary embodiment of the present invention will be described in detail with reference to the drawings.

Structure of Image Forming Apparatus of Exemplary Embodiment

Figure 1:
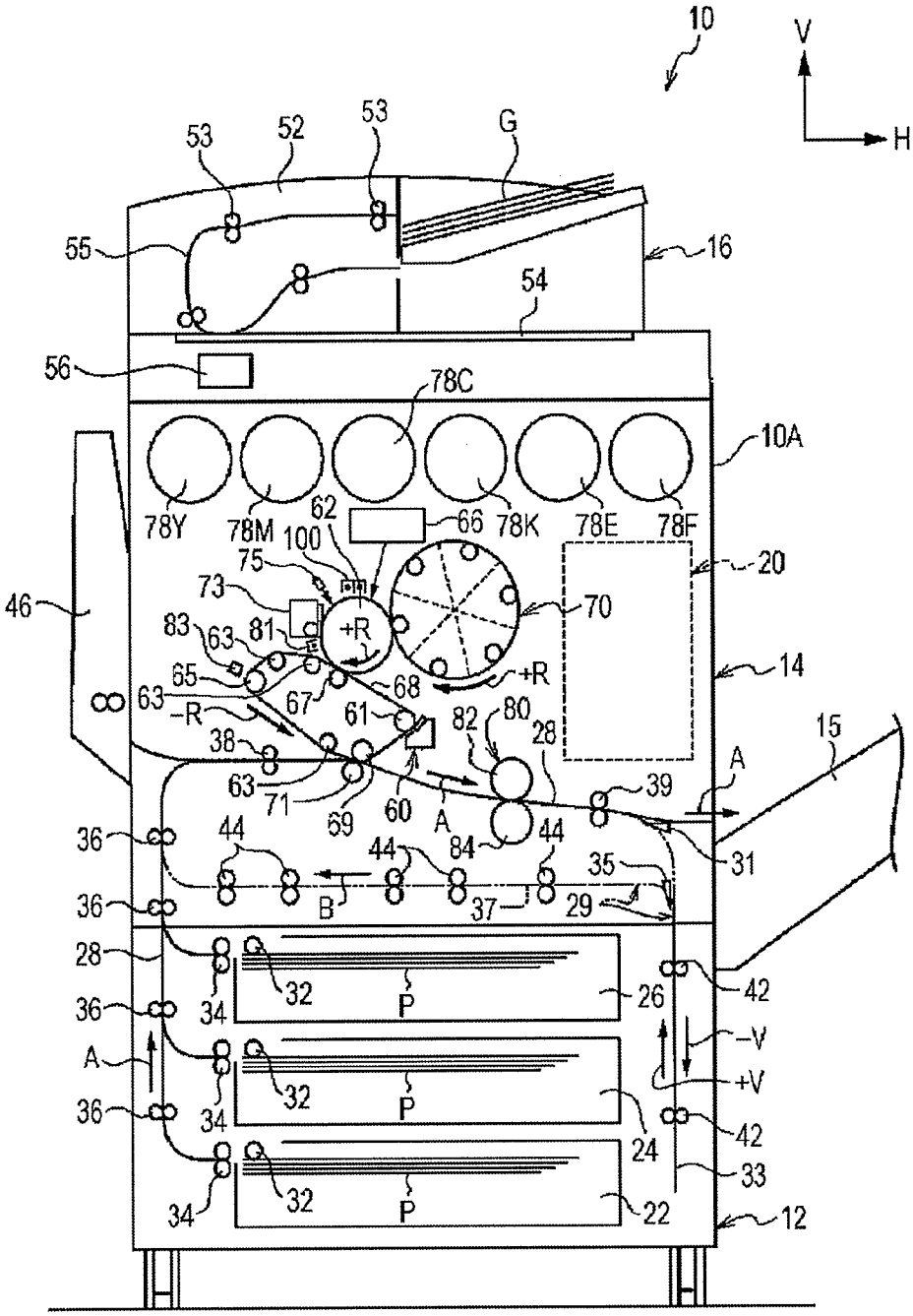
FIG. 1 illustrates the structure of an image forming apparatus according to an exemplary embodiment.

First, the structure of an image forming apparatus according to the present exemplary embodiment will be described. FIG. 1 is a schematic diagram illustrating the structure of an image forming apparatus 10 according to the present exemplary embodiment.

The image forming apparatus 10 includes a sheet storing unit 12 in which sheets of recording paper 2, which are examples of recording media, are stored; an image forming unit 14 which is located above the sheet storing unit 12 and forms images on sheets of recording paper P fed from the sheet storing unit 12; and an original-document reading unit 16 which is located above the image forming unit 14 and reads an original document G. The image forming apparatus 10 also includes a controller 20 that is provided in the image forming unit 14 and controls the operation of each part of the image forming apparatus 10. In the following description, the vertical direction and the horizontal direction with respect to an apparatus body 10A of the image forming apparatus 10 will be referred to as the direction of arrow V and the direction of arrow H, respectively.

The sheet storing unit 12 includes a first storage unit 22, a second storage unit 24, and a third storage unit 26 in which sheets of recording paper P having different sizes are stored. Each of the first storage unit 22, the second storage unit 24, and the third storage unit 26 are provided with a feeding roller 32 that feeds the stored sheets of recording paper P to a transport path 28 in the image forming apparatus 10. Pairs of transport rollers 34 and 36 that transport the sheets of recording paper P one at a time are provided along the transport path 28 in an area on the downstream of each feeding roller 32. A pair of positioning rollers 38 are provided on the transport path 28 at a position downstream of the transport rollers 36 in a transporting direction of the sheets of recording paper P. The positioning rollers 38 temporarily stop each sheet of recording paper P and feed the sheet toward a second transfer position, which will be described below, at a predetermined timing.

In the front view of the image forming apparatus 10, an upstream part of the transport path 28 extends in the direction of arrow V from the left side of the sheet storing unit 12 to the lower left part of the image forming unit 14. A downstream part of the transport path 28 extends from the lower left part of the image forming unit 14 to a paper output unit 15 provided on the right side of the image forming unit 14. A duplex-printing transport path 29, which is provided for reversing and transporting each sheet of recording paper P in a duplex printing process, is connected to the transport path 28.

In the front view of the image forming apparatus 10, the duplex-printing transport path 29 includes a first switching member 31, a reversing unit 33, a transporting unit 37, and a second switching member 35. The first switching member 31 switches between the transport path 28 and the duplex-printing transport path 29. The reversing unit 33 extends linearly in the direction of arrow V from a lower right part of the image forming unit 14 along the right side of the sheet storing unit 12. The transporting unit 37 receives the trailing end of each sheet of recording paper P that has been transported to the reversing unit 33 and transports the sheet in the direction of arrow H. The second switching member 35 switches between the reversing unit 33 and the transporting unit 37. The reversing unit 33 includes plural pairs of transport rollers 42 that are arranged with intervals therebetween, and the transporting unit 37 includes plural pairs of transport rollers 44 that are arranged with intervals therebetween.

The first switching member 31 has the shape of a triangular prism, and a point end of the first switching member 31 is moved by a driving unit (not shown) to one of the transport path 28 and the duplex-printing transport path 29. Thus, the transporting direction of each sheet of recording paper P is changed. Similarly, the second switching member 35 has the shape of a triangular prism, and a point end of the second switching member 35 is moved by a driving unit (not shown) to one of the reversing unit 33 and the transporting unit 37. Thus, the transporting direction of each sheet of recording paper P is changed. The downstream end of the transporting unit 37 is connected to the transport path 28 by a guiding member (not shown) at a position in front of the transport rollers 36 in the upstream part of the transport path 28. A foldable manual sheet-feeding unit 46 is provided on the left side of the image forming unit 14. The sheets of recording paper P may be fed to the positioning rollers 38 on the transport path 28 from the manual sheet-feeding unit 46.

The original-document reading unit 16 includes a document transport device 52 that transports the sheets of the original document G one at a time; a platen glass 54 which is located below the document transport device 52 and on which the sheets of the original document G are placed one at a time; and an original-document reading device 56 that scans each sheet of the original document G while the sheet is being transported by the document transport device 52 or placed on the platen glass 54. The document transport device 52 includes a transport path 55 along which pairs of transport rollers 53 are arranged. A part of the transport path 55 is arranged such that each sheet of the original document G moves along the top surface of the platen glass 54. The original-document reading device 56 scans each sheet of the original document G that is being transported by the document transport device 52 while being stationary at the left edge of the platen glass 54. Alternatively, the original-document reading device 56 scans each sheet of the original document G placed on the platen glass 54 while moving in the direction of arrow H.

The image forming unit 14 includes a cylindrical or columnar photoconductor 62 as an example of a cylindrical or columnar member to be charged. The photoconductor 62 is arranged in a substantially central area of the apparatus body 10A. The photoconductor 62 is rotated in the direction shown by arrow +R (clockwise in FIG. 1) by a driving unit (not shown), and carries an electrostatic latent image formed by irradiation with light. In addition, a scorotron charging device 100 that charges the outer peripheral surface of the photoconductor 62 is provided above the photoconductor 62 so as to face the outer peripheral surface of the photoconductor 62. The detailed structure of the charging device 100 will be described below. The photoconductor 62 includes an overcoat layer that has high abrasion resistance but easily causes image degradation owing to discharge products generated by the charging device 100.

An exposure device 66 is provided so as to face the outer peripheral surface of the photoconductor 62 at a position downstream of the charging device 100 in the rotational direction of the photoconductor 62. The outer peripheral surface of the photoconductor 62 that has been charged by the charging device 100 is irradiated with light (exposed to light) by the exposure device 66 on the basis of an image signal corresponding to each color of toner. Thus, an electrostatic latent image is formed.

A rotation-switching developing device 70 is provided downstream of a position where the photoconductor 62 is irradiated with exposure light by the exposure device 66 in the rotational direction of the photoconductor 62. The developing device 70 visualizes the electrostatic latent image on the outer peripheral surface of the photoconductor 62 by developing the electrostatic latent image with toner of each color.

Figure 2:
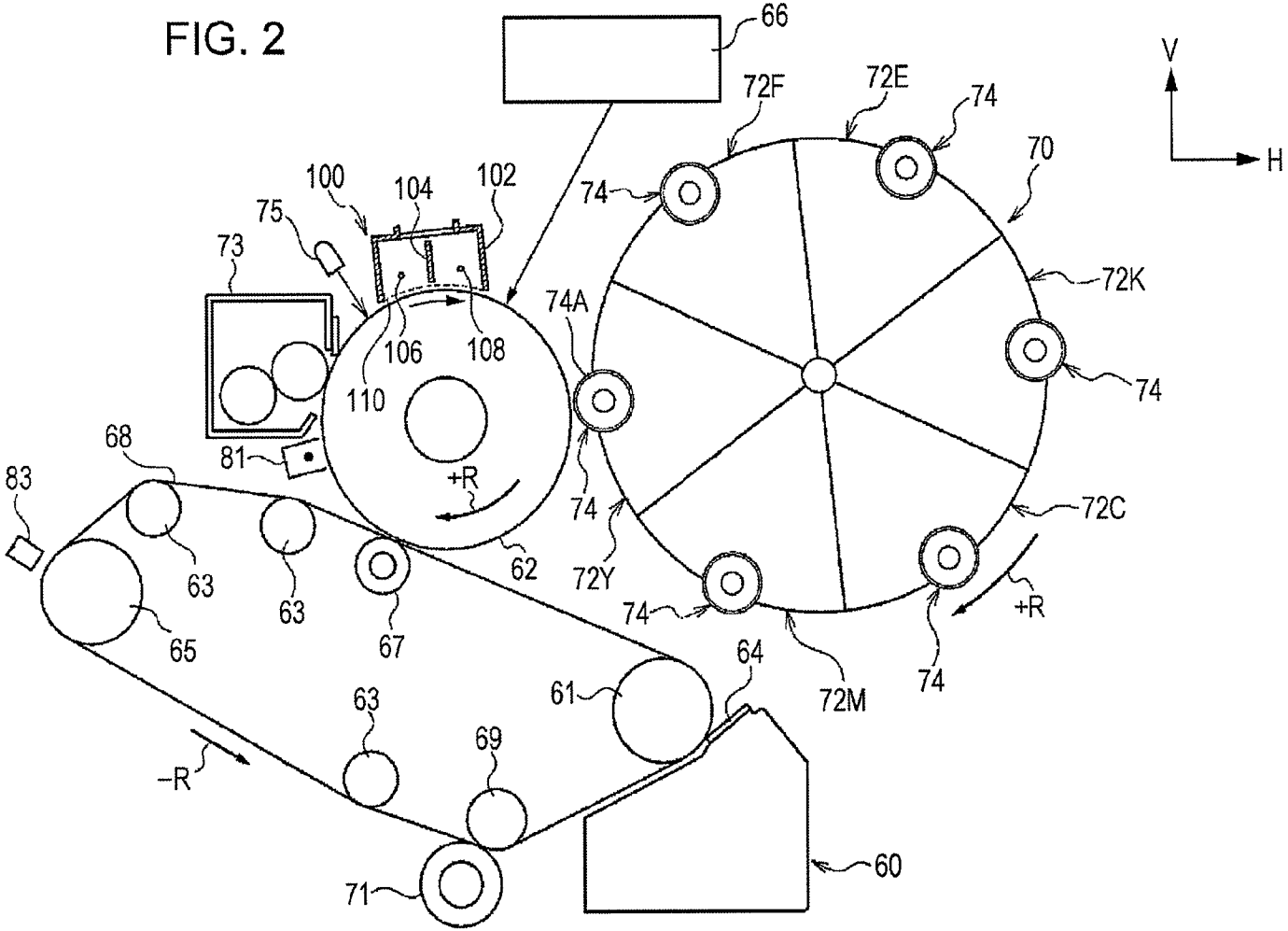
FIG. 2 illustrates the structure of an area around a photoconductor according to the exemplary embodiment.

As illustrated in FIG. 2, the developing device 70 includes developing units 72Y, 72M, 72C, 72K, 72E, and 72F corresponding to the respective colors, which are yellow (Y), magenta (M), cyan (C), black (K), the first specific color (E), and the second specific color (F), respectively. The developing units 72Y, 72M, 72C, 72K, 72E, and 72F are arranged in that order in a circumferential direction (counterclockwise). The developing device 70 is rotated by a motor (not shown), which is an example of a rotating unit, in steps of 60°. Accordingly, one of the developing units 72Y, 72M, 72C, 72K, 72E, and 72F that is to perform a developing process is selectively opposed to the outer peripheral surface of the photoconductor 62. The position at which each developing unit 72Y, 72M, 72C, 72K, 72E, and 72F is opposed to the outer peripheral surface of the photoconductor 62 is a developing position at which the developing process is performed. The developing units 72Y, 72M, 72C, 72K, 72E, and 72F have similar structures. Therefore, only the developing unit 72Y will be described, and explanations of the other developing units 72M, 72C, 72K, 72E, and 72F will be omitted.

The developing unit 72Y is filled with developer (not shown) including toner and carrier. The developer is supplied from a toner cartridge 78Y (see FIG. 1) through a toner supply channel (not shown). The developing unit 72Y is provided with a developing roller 74 having an outer peripheral surface that faces the outer peripheral surface of the photoconductor 62.

The developing roller 74 moves the developer layer on the outer peripheral surface of a developing sleeve 74A to the position where the developing sleeve 74A faces the photoconductor 62. Accordingly, the toner adheres to the latent image (electrostatic latent image) formed on the outer peripheral surface of the photoconductor 62. Thus, the latent image is developed.

Six developing rollers 74 are included in the respective developing units 72Y, 72M, 72C, 72K, 72E, and 72F, and are arranged along the circumferential direction so as to be separated from each other by 60° in terms of the central angle. When the developing units 72Y, 72M, 72C, 72K, 72E, and 72F are switched, the developing roller 74 in the newly selected developing unit 72Y, 72M, 72C, 72K, 72E, and 72F is caused to face the outer peripheral surface of the photoconductor 62.

An intermediate transfer belt 68 is provided downstream of the developing device 70 in the rotational direction of the photoconductor 62 and below the photoconductor 62. A toner image formed on the outer peripheral surface of the photoconductor 62 is transferred onto the intermediate transfer belt 68. The intermediate transfer belt 68 is an endless belt, and is wound around a driving roller 61 that is rotated by the controller 20, a tension-applying roller 65 that applies a tension to the intermediate transfer belt 68, plural transport rollers 63 that are in contact with the back surface of the intermediate transfer belt 68 and are rotationally driven, and an auxiliary roller 69 that is in contact with the back surface of the intermediate transfer belt 68 at a second transfer position, which will be described below, and is rotationally driven. The intermediate transfer belt 68 is rotated in the direction shown by arrow −R (counterclockwise in FIG. 2) when the driving roller 61 is rotated.

A first transfer roller 67 is opposed to the photoconductor 62 with the intermediate transfer belt 68 interposed therebetween. The first transfer roller 67 performs a first transfer process in which the toner image formed on the outer peripheral surface of the photoconductor 62 is transferred onto the intermediate transfer belt 68. The first transfer roller 67 is in contact with the back surface of the intermediate transfer belt 68 at a position downstream of the position where the photoconductor 62 is in contact with the intermediate transfer belt 68 in the moving direction of the intermediate transfer belt 68. The first transfer roller 67 receives electricity from a power source (not shown), so that a potential difference is generated between the first transfer roller 67 and the photoconductor 62, which is grounded. Thus, the first transfer process is carried out in which the toner image on the photoconductor 62 is transferred onto the intermediate transfer belt 68.

A second transfer roller 71, which is an example of a transfer unit, is opposed to the auxiliary roller 69 with the intermediate transfer belt 68 interposed therebetween. The second transfer roller 71 performs a second transfer process in which toner images that have been transferred onto the intermediate transfer belt 68 in the first transfer process are transferred onto the sheet of recording paper P. The position between the second transfer roller 71 and the auxiliary roller 69 serves as the second transfer position at which the toner images are transferred onto the sheet of recording paper P. The second transfer roller 71 is in contact with the intermediate transfer belt 68. The second transfer roller 71 receives electricity from a power source (not shown), so that a potential difference is generated between the second transfer roller 71 and the auxiliary roller 69, which is grounded. Thus, the second transfer process is carried out in which the toner images on the intermediate transfer belt 68 are transferred onto the sheet of recording paper P.

A cleaning device 60, which is an example of a developer collecting device, is opposed to the driving roller 61 with the intermediate transfer belt 68 interposed therebetween. The cleaning device 60 collects residual toner that remains on the intermediate transfer belt 68 after the second transfer process. The cleaning device 60 includes a cleaning blade 64 that comes into contact with the intermediate transfer belt 68 to remove the toner from the intermediate transfer belt 68. The cleaning blade 64 of the cleaning device 60 and the second transfer roller 71 are separated from the outer peripheral surface of the intermediate transfer belt 68 until the toner images of the respective colors are transferred onto the intermediate transfer belt 68 in a superimposed manner (first transfer process) and then transferred onto the sheet of recording paper P (second transfer process).

A position detection sensor 83 is opposed to the tension-applying roller 65 at a position outside the intermediate transfer belt 68. The position detection sensor 83 detects a predetermined reference position on the surface of the intermediate transfer belt 68 by detecting a mark (not shown) on the intermediate transfer belt 68. The position detection sensor 83 outputs a position detection signal that serves as a reference for the time to start an image forming process.

A cleaning device 73 is provided downstream of the first transfer roller 67 in the rotational direction of the photoconductor 62. The cleaning device 73 removes residual toner and the like that remain on the surface of the photoconductor 62 instead of being transferred onto the intermediate transfer belt 68 in the first transfer process. The cleaning device 73 collects the residual toner and the like with a cleaning blade and a brush roller that are in contact with the surface of the photoconductor 62. An erase device 81 is provided upstream of the cleaning device 73 and downstream of the first transfer roller 67 in the rotational direction of the photoconductor 62. The erase device 81 eliminates the charge history left by the first transfer roller 67 by discharging electricity toward the outer peripheral surface of the photoconductor 62. The erase device 81 discharges negative electricity toward the outer peripheral surface of the photoconductor 62 before the residual toner and the like are collected by the cleaning device 73. Accordingly, the history of positive electric charge left by the first transfer roller 67 is eliminated, and the image forming process of the next cycle is prevented from being affected by the electric charge. An erase unit 75 that irradiates the outer peripheral surface of the photoconductor 62 with light to eliminate the history of the negative electric charge is provided downstream of the cleaning device 73 and upstream of the charging device 100.

As illustrated in FIG. 1, the second transfer position at which the toner images are transferred onto the sheet of recording paper P by the second transfer roller 71 is at an intermediate position of the above-described transport path 28. A fixing device 80 is provided on the transport path 28 at a position downstream of the second transfer roller 71 in the transporting direction of the sheet of recording paper P (direction shown by arrow A). The fixing device 80 fixes the toner images that have been transferred onto the sheet of recording paper P by the second transfer roller 71. The fixing device 80 includes a heating roller 82 and a pressing roller 84. The heating roller 82 is disposed at the side of the sheet of recording paper P at which the toner images are formed (upper side), and includes a heat source which generates heat when electricity is supplied thereto. The pressing roller 84 is positioned below the heating roller 82, and presses the sheet of recording paper P against the outer peripheral surface of the heating roller 82. Transport rollers 39 that transport the sheet of recording paper P to the paper output unit 15 or the reversing unit 33 are provided on the transport path 28 at a position downstream of the fixing device 80 in the transporting direction of the sheet of recording paper P.

Toner cartridges 78Y, 78M, 78C, 78K, 78E, and 78F that respectively contain yellow (Y) toner, magenta (M) toner, cyan (C) toner, black (K) toner, toner of a first specific color (E), and toner of a second specific color (F) are arranged in the horizontal direction in a replaceable manner in an area below the original-document reading device 56 and above the developing device 70. The first and second specific colors E and F may be selected from specific colors (including transparent) other than yellow, magenta, cyan, and black. Alternatively, the first and second specific colors E and F are not selected.

When the first and second specific colors E and F are selected, the developing device 70 performs the image forming process using six colors, which are Y, M, C, K, F, and F. When the first and second specific colors E and F are not selected, the developing device 70 performs the image forming process using four colors, which are Y, M, C, and K. In the present exemplary embodiment, the case in which the image forming process is performed using the six colors, which are Y, M, C, K, F, and F will be described as an example. However, as another example, the image forming process may be performed using five colors, which are Y, M, C, K, and one of the first and second specific colors E and F.

Structure of Charging Device 100

The structure of the charging device 100 will now be described.

As illustrated in FIG. 2, the charging device 100 includes a shield case 102 made of aluminum as an example of a housing that is open at the side opposed to the photoconductor 62. The shield case 102 has the shape of a long box (see FIG. 3) that extends in an axial direction of the photoconductor 62. As illustrated in FIG. 2, a partition plate 104 is provided in the shield case 102 so as to divide the inner space of the shield case 102 at a central position thereof in the width direction (circumferential direction of the photoconductor 62).

Discharge wires 106 and 108, which are examples of discharge electrodes, are arranged in the shield case 102 at either side of the partition plate 104. The discharge wires 106 and 108 extend in the axial direction of the photoconductor 62. The discharge wires 106 and 108 are formed of metal wires made of tungsten or the like. The discharge electrodes may instead be discharge members formed of wires coated with resin or metal plates, and are not limited as long as the discharge electrodes are capable of discharging electricity.

The discharge wires 106 and 108 generate a negative charge when a voltage is applied thereto from a power source (not shown), and performs a discharging operation of supplying the negative charge to the surface of the photoconductor 62. The photoconductor 62 is charged with electricity as a result of this discharging operation.

A grid 110, which is an example of a potential control plate, is disposed between the photoconductor 62 and the discharge wires 106 and 108 at the open side of the shield case 102. The grid 110 extends along the axial direction of the photoconductor 62.

The grid 110 extends in the axial direction of the photoconductor 62. In other words, the long-side direction of the grid 110 extends along the axial direction of the photoconductor 62, and the short-side direction of the grid 110 extends along the circumferential direction of the photoconductor 62. The grid 110 is formed of a metal plate in which plural openings 119 are formed (see, for example, FIGS. 7A and 7B). The openings 119 are formed as spaces obtained by sectioning slits 128 between structural lines 127 to 129 and 130, which will be described below, with beams 140, which will be described below.

The negative charge generated by the discharge wires 106 and 108 is supplied to the photoconductor 62 through the openings 119 formed in the grid 110. The amount of negative charge that passes through the grid 110 is controlled by a grid voltage, which is controlled by a controller (not shown). Thus, the charge potential of the photoconductor 62 is controlled.

More specifically, in the case where the voltage (potential) of the grid 110 is higher than the potential of the photoconductor 62, the negative charge moves toward the photoconductor 62 due to the potential difference between the photoconductor 62 and the grid 110. Accordingly, a large amount of negative charge passes through the grid 110. When the negative charge is supplied to the photoconductor 62, the potential difference between the photoconductor 62 and the grid 110 decreases. Accordingly, the amount of negative charge that passes through the grid 110 decreases. Thus, when the grid voltage of the grid 110 is high, compared to the case in which the grid voltage is low, the amount of negative charge that passes through the grid 110 is increased and the charge potential of the photoconductor 62 is increased accordingly.

Figure 3:
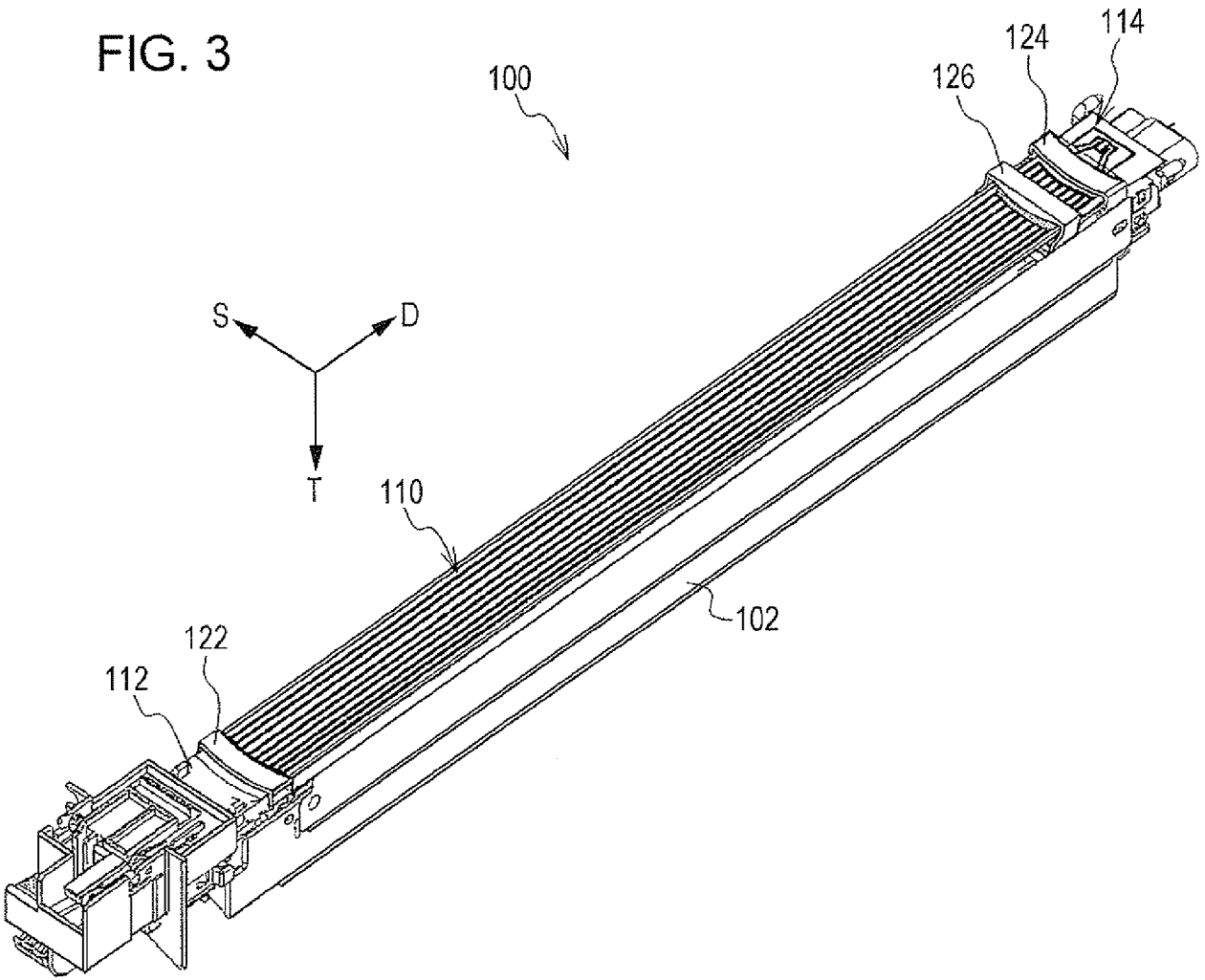
FIG. 3 is a perspective view of a charging device according to the exemplary embodiment.

As illustrated in FIG. 3, the charging device 100 includes a cleaning member 126 that cleans the discharge wires 106 and 108 and the grid 110 by moving along the axial direction of the photoconductor 62 while being in contact with the discharge wires 106 and 108 and the grid 110. The cleaning member 126 includes portions that sandwich the grid 110 from both sides thereof in the thickness direction. The cleaning member 126 may be formed of, for example, a porous material, such as sponge, or a brush-shaped cleaning brush.

Attachment Structure of Grid 110

As illustrated in FIG. 3, the charging device 100 includes attachment members 112 and 114, which are examples of curve regulating members, at both ends of the shield case 102 in the long-side direction thereof. The attachment members 112 and 114 are used to attach (retain) the grid 110. The attachment member 112 is provided at one end (lower left end in FIG. 3) of the shield case 102 in the long-side direction, and the attachment member 114 is provided at the other end (upper right end in FIG. 3) of the shield case 102 in the long-side direction. In FIG. 3, the direction shown by arrow D is the long-side direction of the grid 110, the direction shown by arrow S is the short-side direction of the grid 110, and the direction shown by arrow T is the thickness direction of the grid 110. The directions shown by arrows D, S, and T are orthogonal to each other.

Figure 5:
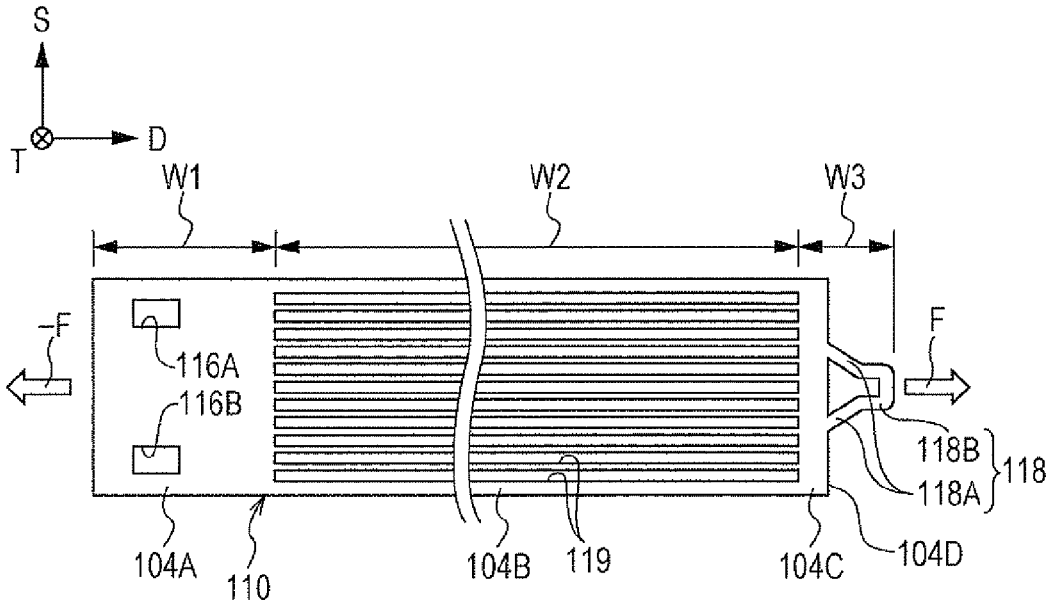
FIG. 5 is a plan view of a grid according to the exemplary embodiment.

As illustrated in FIG. 5, the grid 110 has the shape of a plate (a rectangular shape in plan view and a plate shape in side view) that has a long-side direction in the axial direction of the photoconductor 62 (see FIG. 2) (direction shown by arrow D) when no load is applied. The grid 110 is elastically deformed and curved when a load is applied thereto. The grid 110 includes an attachment portion 104A having a width W1, an electrode portion 104B having a width W2, and an attachment portion 104C having a width W3, which are arranged along the long-side direction of the grid 110 and integrated with each other.

The grid 110 is retained in a tensioned state at both ends thereof in the long-side direction, and a voltage is applied to the grid 110 by a feeder unit (not shown). Here, members having the shape of a plate are not limited to flat plate-shaped members, and include members that are slightly curved when viewed in the direction shown by arrow D.

The attachment portion 104A has attachment holes 116A and 116B, which are through holes that extend through the attachment portion 104A in the thickness direction of the grid 110. The attachment holes 116A and 116B have a rectangular shape and are formed with an interval therebetween in the short-side direction of the grid 110 (direction shown by arrow S).

An attachment piece 118 that projects outward in the long-side direction of the grid 110 is formed on the attachment portion 104C. The attachment piece 118 includes two support portions 118A that are slanted toward each other in plan view and a hook portion 118B that is angular-U-shaped in plan view and that is integrated with each of the two support portions 118A at an end thereof (at the right end in FIG. 5). The other end (the left end in FIG. 5) of each support portion 118A is integrated with a surface 104D at an end of the grid 110 (right end face in FIG. 5) at a central area thereof in the direction shown by arrow S.

Figure 4A:
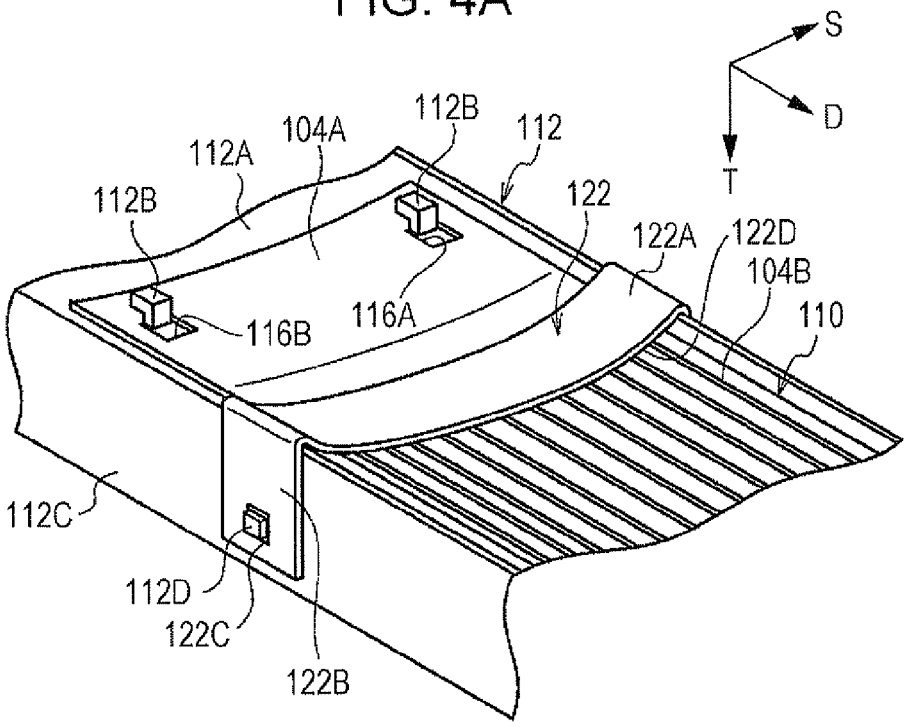
FIGS. 4A and 4B illustrate an attachment structure of the charging device according to the exemplary embodiment.

Referring to FIG. 4A, the attachment member 112 includes a curved surface 112A and side surfaces 112C. The curved surface 112A is disposed between the grid 110 and the discharge wires 106 and 108 (see FIG. 2) and extends along the outer peripheral surface of the photoconductor 62 (see FIG. 2). The side surfaces 112C extend in the direction shown by arrow T from the ends of the curved surface 112A in the direction shown by arrow S.

Two L-shaped hook portions 112E that project toward the photoconductor 62 (upward in FIG. 4A) and that are bent outward in the axial direction of the photoconductor 62 (toward the upper left in FIG. 4A) are formed on the curved surface 112A. The size of the two hook portions 112B is set such that the hook portions 112B may be inserted into the attachment holes 116A and 116B. The hook portions 112B are formed of leaf springs and pull the grid 110 outward in the axial direction of the photoconductor 62 (toward the upper left in FIG. 4A). Thus, the hook portions 112B serve as tension applying members that apply a tension to the grid 110 in the axial direction of the photoconductor 62.

Projections 1120 used to fix a leaf spring 122, which will be described below, project from the side surfaces 112C of the attachment member 112 (only one of the side surfaces 112C is illustrated). The hook portions 112B are engaged with the edges of the attachment holes 116A and 116B in the grid 110, so that a first end of the grid 110 is positioned. The grid 110 is retained at the first end thereof by the urging force applied by the leaf spring 122, which is an example of a curve maintaining member, such that the grid 110 is curved along the outer peripheral surface of the photoconductor 62.

The leaf spring 122 includes a curved portion 122A and attachment portions 122B which are integrated with each other. The curved portion 122A extends in the direction shown by arrow S and is curved to be convex in the direction shown by arrow T (downward in FIG. 4A). The attachment portions 122B extend in the direction shown by arrow T from the ends of the curved portion 122A in the direction shown by arrow S. Engagement holes 122C, with which the projections 112D are engaged, are formed in the attachment portions 122B. The convex surface of the curved portion 122A serves as a contact surface 122D that contacts the grid 110.

Figure 4B:
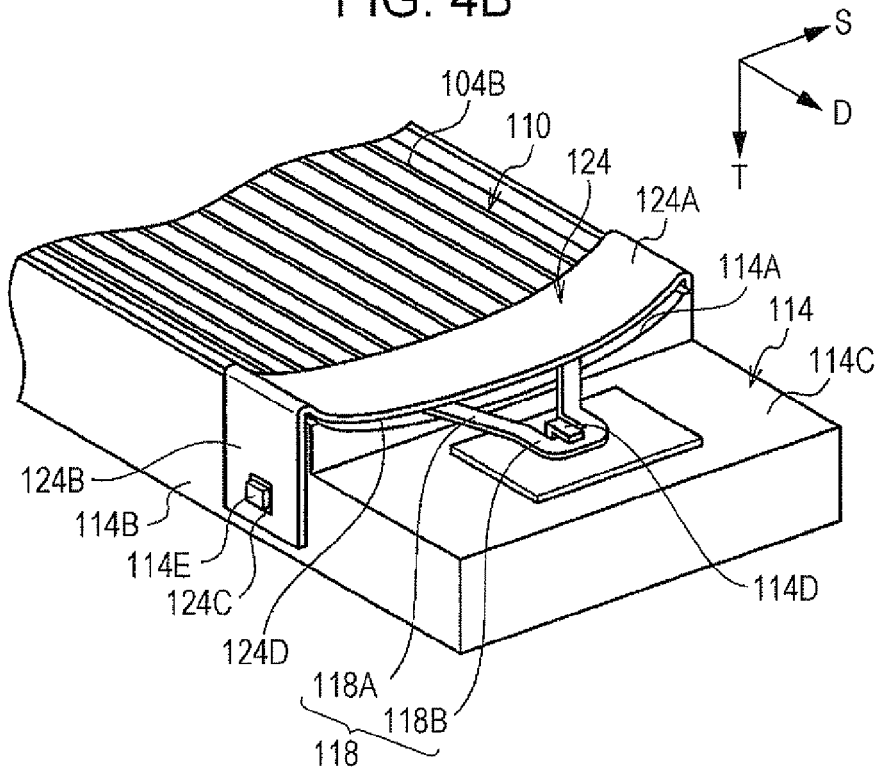

Referring to FIG. 4B, the attachment member 114 includes a curved surface 114A, side surfaces 114B, and an attachment surface 114C. The curved surface 114A is disposed between the grid 110 and the discharge wires 106 and 108 (see FIG. 2) and extends along the outer peripheral surface of the photoconductor 62 (see FIG. 2). The side surfaces 114B extend in the direction shown by arrow T from the ends of the curved surface 114A in the direction shown by arrow S. The attachment surface 114C is provided at the second end in the direction shown by arrow D such that the attachment surface 114C is lower than the curved surface 114A.

An L-shaped hook portion 114D that projects toward the photoconductor 62 (upward in FIG. 4B) and that is bent outward in the axial direction of the photoconductor 62 (toward the lower right in FIG. 4B) are formed on the attachment surface 114C. The hook portion 114D is formed on the attachment surface 1140 at a central area thereof in the direction shown by arrow S. The size of the hook portion 114D is set such that the hook portion 118B of the grid 110 may be engaged with the hook portion 114D. The hook portion 114D is formed of a leaf spring and pulls the grid 110 outward in the axial direction of the photoconductor 62 (toward the lower right in FIG. 4B). Thus, the hook portion 114D serves as a tension applying member that applies a tension to the grid 110 in the axial direction of the photoconductor 62.

Projections 114E used to fix a leaf spring 124, which will be described below, project from the side surfaces 114B of the attachment member 114 (only one of the side surfaces 114B is illustrated). The hook portion 118B of the grid 110 is engaged with the hook portion 114D, so that a second end of the grid 110 is positioned. The grid 110 is retained at the second end thereof by the urging force applied by the leaf spring 124, which is an example of a curve maintaining member. Accordingly, the state in which the grid 110 is curved along the outer peripheral surface of the photoconductor 62 is maintained.

The leaf spring 124 includes a curved portion 124A and attachment portions 124B which are integrated with each other. The curved portion 124A extends in the direction shown by arrow S and is curved to be convex in the direction shown by arrow T (downward in FIG. 4B). The attachment portions 124B extend in the direction shown by arrow T from the ends of the curved portion 124A in the direction shown by arrow S. Engagement holes 124C, with which the projections 114E are engaged, are formed in the attachment portions 124B. The convex surface of the curved portion 124A serves as a contact surface 1240 that contacts the grid 110.

Projecting contact portions (not shown) formed on the leaf springs 122 and 124 are in contact with top portions of holders (not shown) provided at the ends of the photoconductor 62 (see FIG. 2), so that a distance between the photoconductor 62 and the grid 110 is maintained at a certain distance.

The hook portions 112B and 114D may pull the grid 110 toward the discharge wires 106 and 108 (downward in FIGS. 4A and 4B) so as to curve the grid 110 by urging the grid 110 against the curved surfaces 112A and 114A. In such a case, the leaf springs 122 and 124, which are examples of curve maintaining members, may be omitted.

Structure of Electrode Portion 104B of Grid 110

Figure 6:
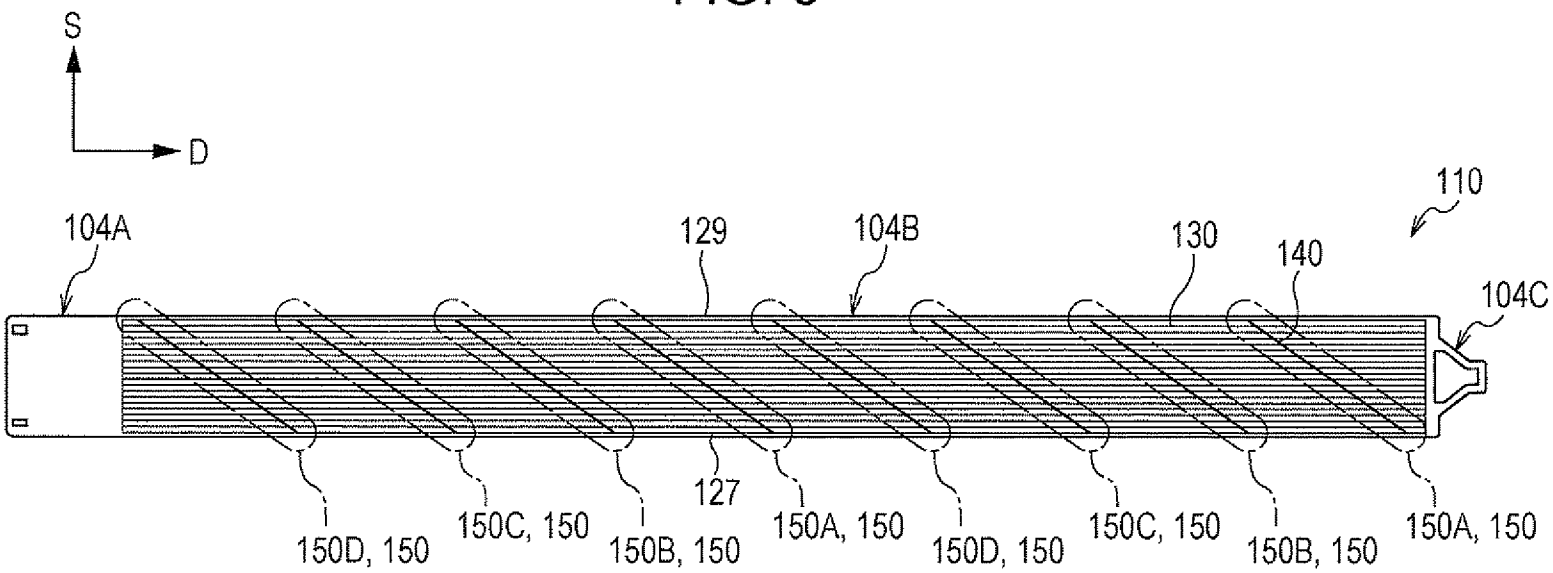
FIG. 6 is a plan view of a grid according to the exemplary embodiment.

The structure of the electrode portion 104B of the grid 110 will now be described. FIGS. 6 to 85 illustrate the structure of the electrode portion 104B of the grid 110. In FIGS. 3 to 5, thin lines 130, which will be described below, are not illustrated.

Figure 7A:
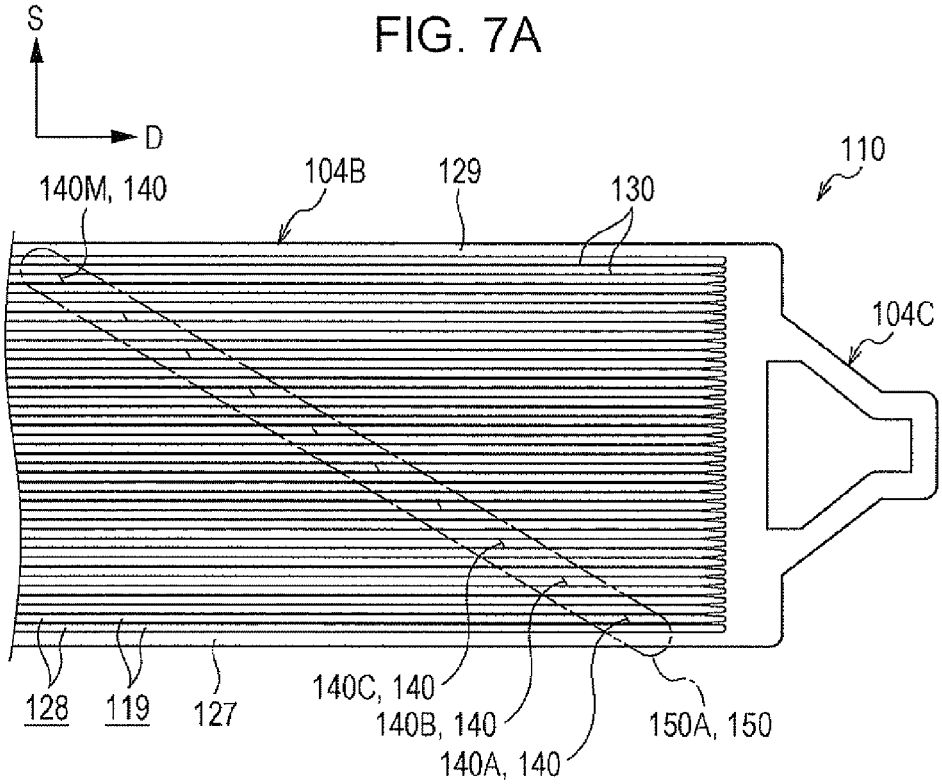
FIGS. 7A and 7B are enlarged partial plan views of the grid according to the exemplary embodiment.
Figure 7B:
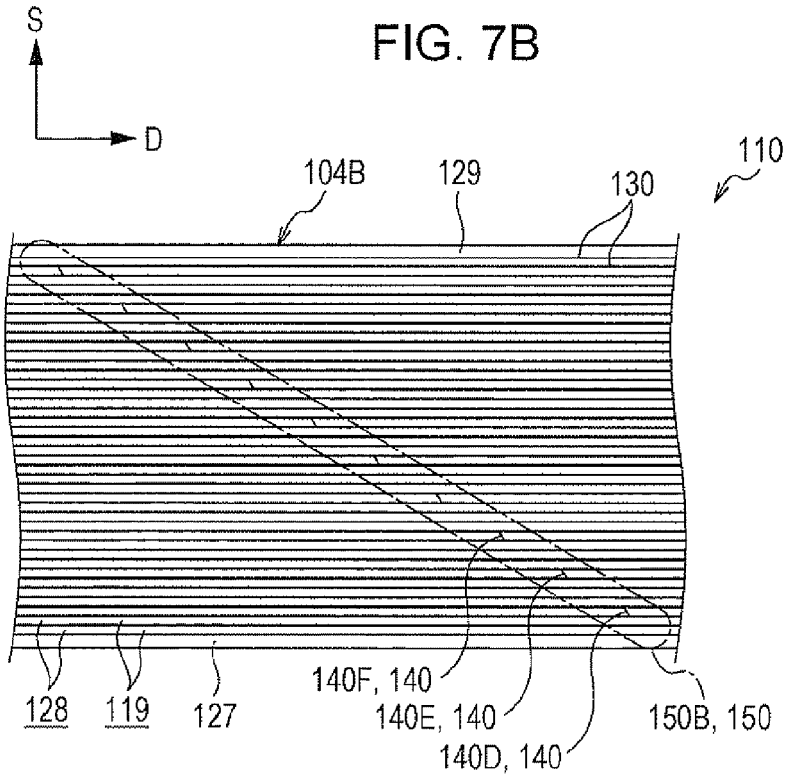

As illustrated in FIGS. 6 and 7A, the electrode portion 104B of the grid 110 includes plural (at least three) thin lines 130. The thin lines 130 are arranged along the circumferential direction of the photoconductor 62 (direction shown by arrow S) and linearly extend along the axial direction of the photoconductor 62 (direction shown by arrow D). Linear portions 127 and 129 are provided at both ends of the grid 110 in the short-side direction thereof (in the direction shown by arrow S). The linear portions 127 and 129 linearly extend along the axial direction of the photoconductor 62 with all of the thin lines 130 disposed therebetween. In the present exemplary embodiment, the linear portions 127 and 129 and the thin lines 130 serve as structural lines that linearly extend in the axial direction of the photoconductor 62. In the following description, the linear portions 127 and 129 and the thin lines 130 are sometimes referred to as structural lines 127 to 129 and 130.

Each of the linear portions 127 and 129 and the thin lines 130 is fixed to the attachment portion 104A at one end thereof and to the attachment portion 104C at the other end thereof. Thus, the thin lines 130 are surrounded by a frame-shaped structure including the linear portions 127 and 129 and the attachment portions 104A and 104C.

As illustrated in FIG. 7A, the electrode portion 104B of the grid 110 includes plural beams 140, which are examples of connecting portions that connect two or more of the structural lines 127 to 129 and 130 that are next to each other in the circumferential direction of the photoconductor 62 (direction shown by arrow S). More specifically, each beam 140 connects two of the structural lines 127 to 129 and 130 that are next to each other in the circumferential direction of the photoconductor 62.

The plural beams 140 are arranged in the axial direction of the photoconductor 62 (direction shown by arrow D). According to the present exemplary embodiment, the structure in which the beams 140 are arranged in the axial direction of the photoconductor 62 is the structure in which one of the beams 140 and another one of the beams 140 are disposed at different positions in the axial direction of the photoconductor 62. Therefore, the structure in which the beams 140 are arranged in the axial direction of the photoconductor 62 includes the structure in which the beams 140 are arranged in the axial direction of the photoconductor 62 while positions thereof in the circumferential direction of the photoconductor 62 are shifted from each other.

In the present exemplary embodiment, the beams 140 in the electrode portion 104B are formed such that plural beam groups 150 which each include plural beams 140 are provided. In each beam group 150, the beams 140 are continuously arranged in the axial direction of the photoconductor 62 from the linear portion 127 to the linear portion 129. As illustrated in FIG. 6, the beam groups 150 include two sets of beam groups 150A, 150B, 150C, and 150D, and eight beam groups in total are provided. The beam groups are arranged in order of 150A, 1508, 150C, 150D, 150A, 150B, 150C, and 150D, along the axial direction of the photoconductor 62. Each of the beam groups 150A, 1508, 150C, and 150D includes, for example, ten beams 140. In FIG. 6, the beam groups 150A, 150B, 150C, and 150D are drawn in a simplified manner.

In each of the beam groups 150A, 150B, 150C, and 150D, the beams 140 are arranged at a constant pitch along the circumferential direction of the photoconductor 62. In other words, the beams 140 are arranged with the same number of slits 128 (the same number of thin lines 130) disposed therebetween. In the present exemplary embodiment, the beams 140 are arranged with three slits 128 and two thin lines 130 disposed therebetween.

More specifically, in each of the two beam groups 150A, the first beam 140A from the bottom in FIG. 7A connects the first and second thin lines 130 from the bottom in FIG. 7A to each other. The second beam 1408 skips three slits 128 and connects the fifth and sixth thin lines 130 to each other. The third beam 140C skips three slits 128 and connects the ninth and tenth thin lines 130 to each other. In this manner, the beams 140 connect two thin lines 130 to each other at positions where three slits 128 are disposed between the beams 140. In FIG. 7A, only the beam group 150A near the attachment portion 104C is illustrated.

In each of the two beam groups 150B, the first beam 140D from the bottom in FIG. 78 connects the second and third thin lines 130 from the bottom in FIG. 78 to each other. The second beam 1408 skips three slits 128 and connects the sixth and seventh thin lines 130 to each other. The third beam 140F skips three slits 128 and connects the tenth and eleventh thin lines 130 to each other. In this manner, the beams 140 connect two thin lines 130 to each other at positions where three slits 128 are disposed between the beams 140.

Figure 8A:
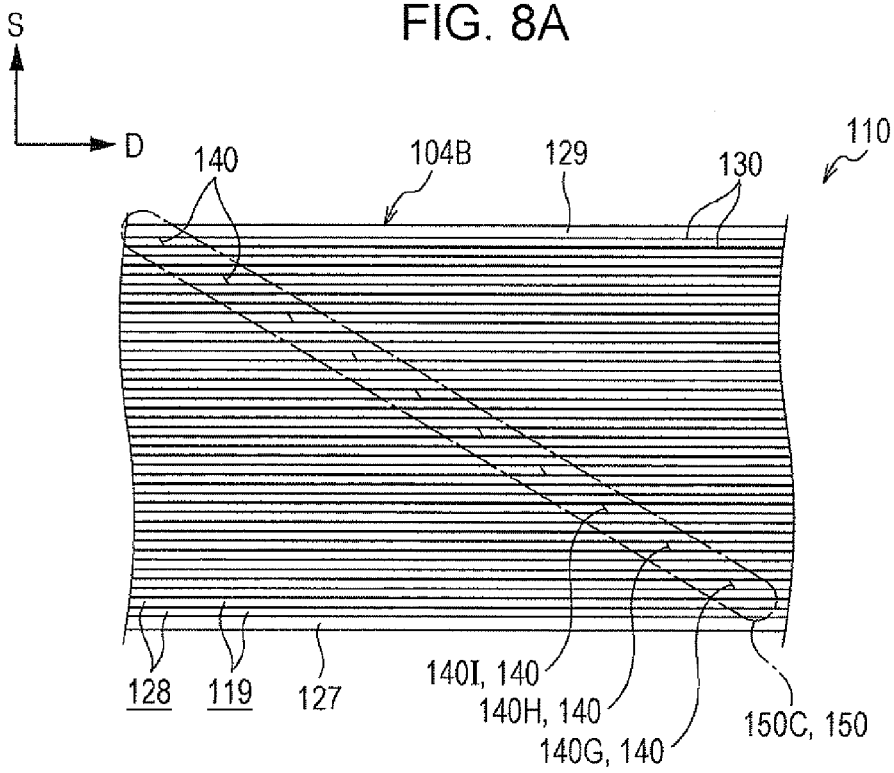
FIGS. 8A and 8B are enlarged partial plan views of the grid according to the exemplary embodiment.

In each of the two beam groups 150C, the first beam 140G from the bottom in FIG. 8A connects the third and fourth thin lines 130 from the bottom in FIG. 8A to each other. The second beam 140H skips three slits 128 and connects the seventh and eighth thin lines 130 to each other. The third beam 140I skips three slits 128 and connects the eleventh and twelfth thin lines 130 to each other. In this manner, the beams 140 connect two thin lines 130 to each other at positions where three slits 128 are disposed between the beams 140.

Figure 8B:
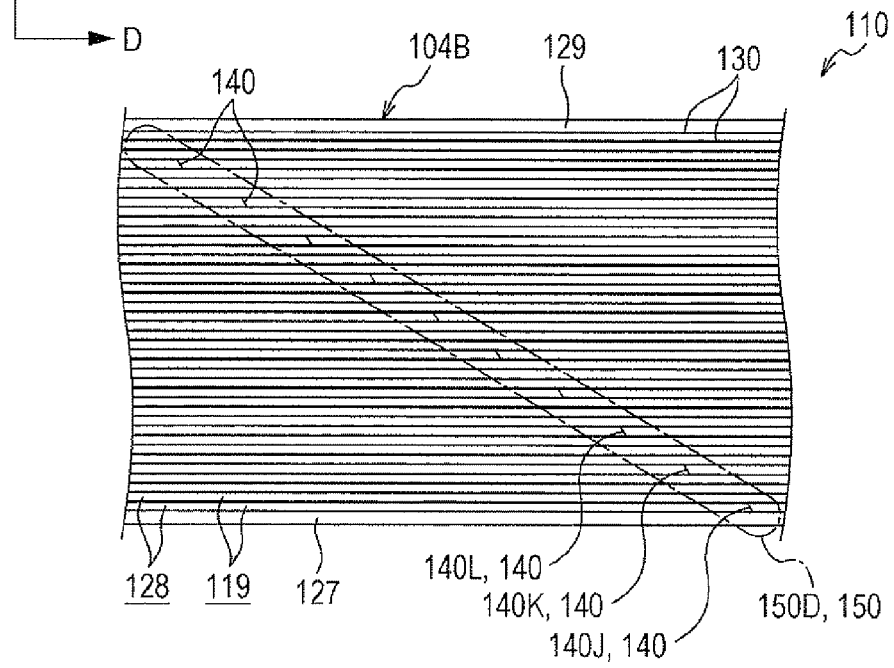

In each of the two beam groups 150D, the first beam 140J from the bottom in FIG. 8B connects the linear portion 127 and the first thin line 130 from the bottom in FIG. 8B to each other. The second beam 140K skips three slits 128 and connects the fourth and fifth thin lines 130 to each other. The third beam 140L skips three slits 128 and connects the eighth and ninth thin lines 130 to each other. In this manner, the beams 140 connect two thin lines 130 to each other at positions where three slits 128 are disposed between the beams 140.

Thus, in each of the beam groups 150A, 150B, 150C, and 150D, the beams 140 that are next to each other in the axial direction of the photoconductor 62 have three slits 128 disposed therebetween. In other words, in each of the beam groups 150R, 150B, 150C, and 150D, the beams 140 that are next to each other in the axial direction of the photoconductor 62 connect pairs of thin lines 130 that are all different from each other. The beams 140 that are next to each other in the axial direction of the photoconductor 62 are, for example, the beams 140A and 140B or the beams 140B and 140C in the beam group 150A.

In a connecting area between the beam groups 150A and 150B, the beam 140M at the terminal end (left end in FIG. 7A) of the beam group 150A and the beam 140D at the start end (right end in FIG. 7B) of the beam group 150B have one or more slits (more specifically, 32 slits) 128 disposed therebetween. The beams 140M and 140D connect the pairs of thin lines 130 that are all different from each other. This also applies to a connecting area between the beam groups 150E and 150C, a connecting area between the beam groups 150C and 150D, and a connecting area between the beam groups 150D and 150A.

Owing to the above-described arrangement of the beams 140, no thin line 130 is provided independently, and the thin lines 130 that are next to each other are connected to each other by one or more of the beams 140. In the present exemplary embodiment, two beams 140 are provided in each of the slits 128 between the thin lines 130, and the thin lines 130 that are next to each other are connected to each other by the beams 140 at two positions.

In each of the beam groups 150A, 150B, 150C, and 150D, the beams 140 are arranged in the axial direction of the photoconductor 62 at constant intervals. In addition, in the connecting area between the beam groups 150A and 150B, the interval between the beam 140M at the terminal end (left end in FIG. 7A) of the beam group 150A and the beam 140D at the start end (right end in FIG. 7B) of the beam group 150B is equal to the intervals between the beams 140 in each of the beam groups 150A, 150B, 150C, and 150D. This also applies to the connecting area between the beam groups 150B and 150C, the connecting area between the beam groups 150C and 150D, and the connecting area between the beam groups 150D and 150A.

The beams 140 are at an angle of 60 degrees with respect to the thin lines 130. In the structure of the present exemplary embodiment, when the angle of the beams 140 with respect to the thin lines 130 is substantially 20 degrees or more or 20 degrees of more, the cleaning member 126 is prevented from being scratched by portions between the thin lines 130 and the beams 140. The angle at which the cleaning member 126 is prevented from being scratched by portions between the thin lines 130 and the beams 140 is determined by actually moving the cleaning member 126 a predetermined number of times in the long-side direction of the grid 110 and visually checking whether or not the cleaning member 126 have been scratched. To effectively prevent the cleaning member 126 from being scratched, portions at which the beams 140 and the thin lines 130 intersect may be formed in a curved shape.

Operations of Present Exemplary Embodiment

The operations of the present exemplary embodiment will now be described below.

According to an aspect of the exemplary embodiment, compared to the structure in which the beams 140 are not provided and only the thin lines 130 are provided, the strength of the grid 110 may be increased. Accordingly, in the case where the grid 110 is formed by etching in the manufacturing process, the grid 110 may be easily released from a die. As a result, the yield may be increased. In addition, since the thin lines 130 do not easily become entangled when the grid 110 is attached, the grid 110 may be easy to handle. When the grid 110 is attached to the shield case 102, vibration of the grid 110 generated by the electric field between the grid 110 and the photoconductor 62 may be reduced. Accordingly, leakage caused when the grid 110 comes into contact with the photoconductor 62 is reduced.

In addition, according to another aspect of the exemplary embodiment, compared to the structure in which the beams 140 are not provided and only the thin lines 130 are provided, the gaps between the thin lines 130 (opening widths of the slits 128 in the circumferential direction of the photoconductor 62) may be made more uniform along the axial direction of the photoconductor 62. Accordingly, the occurrence of non-uniform charging of the photoconductor 62 in the axial direction thereof may be reduced.

In addition, in the structure according to another aspect of the exemplary embodiment, the beams 140 are dispersed in the axial direction of the photoconductor 62 and are also dispersed in the circumferential direction of the photoconductor 62. Therefore, non-uniform charging in the axial direction of the photoconductor 62 caused when the beams 140 block the electric charges that travel from the discharge wires 106 and 108 to the photoconductor 62 may be suppressed.

In addition, according to another aspect of the exemplary embodiment, the angle of the beams 140 with respect to the thin lines 130 may be set to an angle larger than the angle at which the cleaning member 126 is prevented from being scratched by portions between the thin lines 130 and the beams 140 (that is, substantially 20 degrees or 20 degrees). More specifically, the angle of the beams 140 with respect to the thin lines 130 may be set to 60 degrees. Accordingly, the cleaning member 126 may be prevented from being scratched by portions between the thin lines 130 and the beams 140 even when the grid 110 is cleaned by the cleaning member 126. Thus, the cleaning member 126 may be prevented from being damaged.

The arrangement in which the beams 140 are disposed between the thin lines 130 is not limited to the above-described arrangement. For example, the beams 140 may instead be arranged as described below. In the following description, portions similar to those of the grid 110 are denoted by the same reference numerals, and explanations thereof are thus omitted.

First Modification of Grid 110

Figure 9:
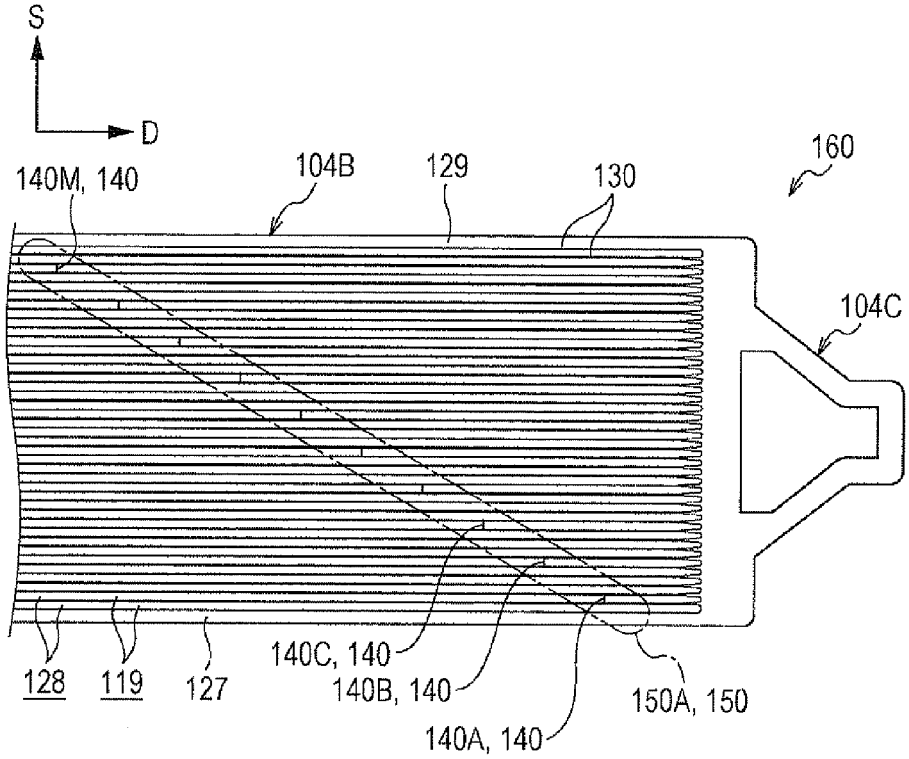
FIG. 9 is an enlarged partial plan view of a grid according to a first modification.

In the grid 110, the beams 140 are at an angle of 60 degrees with respect to the thin lines 130. In contrast, a grid 160 according to a first modification, the beams 140 are at an angle of 90 degrees with respect to the thin lines 130, as illustrated in FIG. 9. Other structures of the grid 160 are similar to those of the grid 110.

According to an aspect of the first modification, the angle of the beams 140 with respect to the thin lines 130 may be set to an angle larger than the angle at which the cleaning member 126 may be prevented from being scratched by portions between the thin lines 130 and the beams 140 (that is, substantially 20 degrees or 20 degrees). More specifically, the angle of the beams 140 with respect to the thin lines 130 may be set to 90 degrees. Accordingly, the cleaning member 126 may be prevented from being scratched by portions between the thin lines 130 and the beams 140 even when the grid 160 is cleaned by the cleaning member 126. Thus, the cleaning member 126 may be prevented from being damaged.

In addition, according to an aspect of the first modification, in the state in which the grid 160 is elastically deformed along the circumferential direction of the photoconductor 62 (direction shown by arrow S in FIG. 9), the beams 140 extend along the circumferential direction of the photoconductor 62. Accordingly, the force that tries to deform the grid 160 in a direction oblique to the circumferential direction of the photoconductor 62 may be reduced.

Second Modification of Grid 110

Figure 10A:
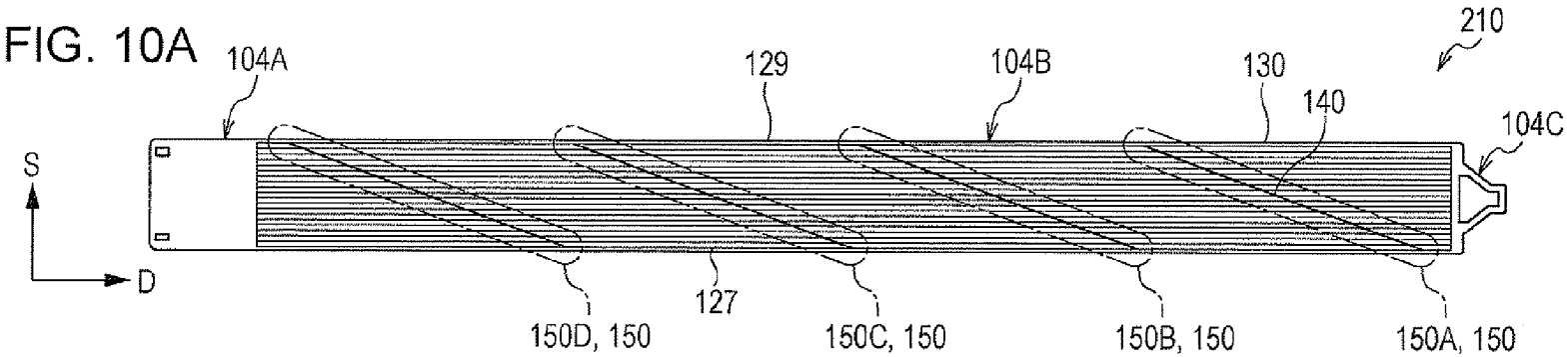
FIG. 10A is a plan view of a grid according to a second modification.
Figure 10B:
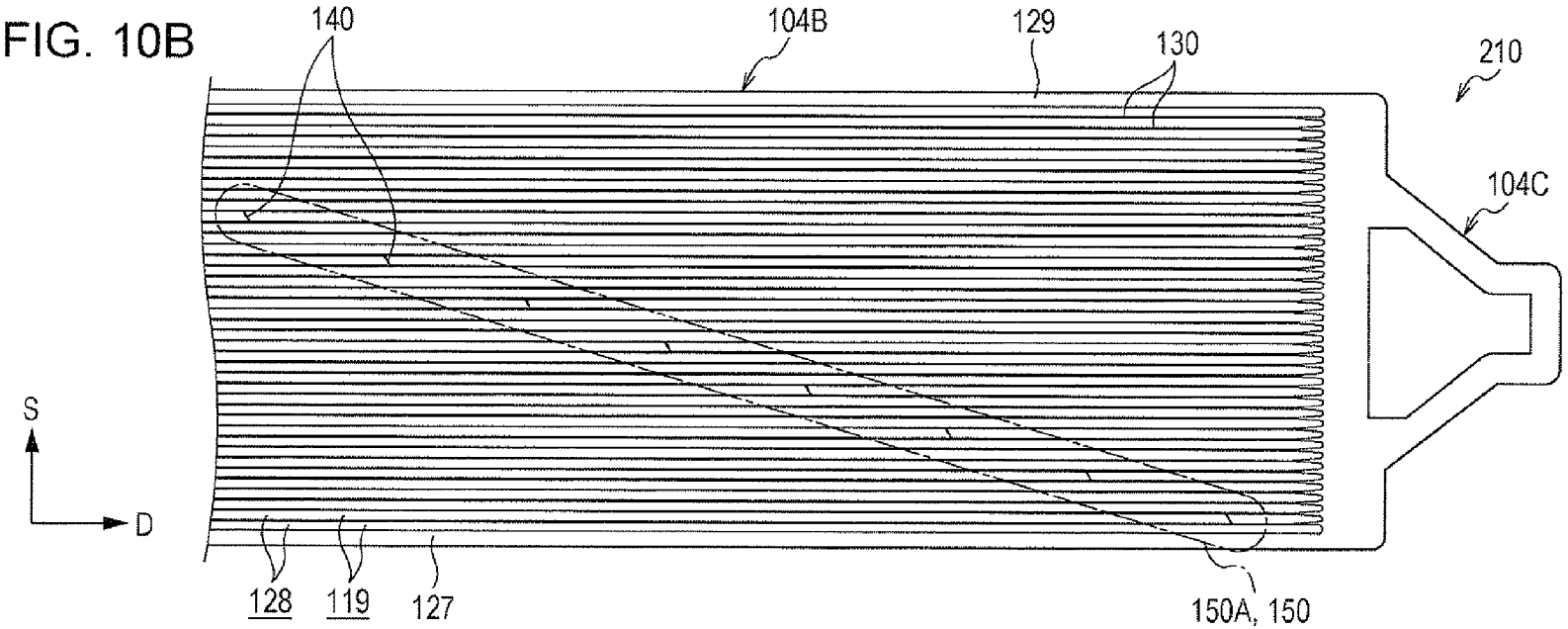
FIG. 10B is an enlarged partial plan view of the grid according to the second modification.

In the grid 110, the beam groups 150 include two sets of beam groups 150A, 150B, 150C, and 150D, and eight beam groups in total are provided. In contrast, in a grid 210 according to a second modification, the beam groups 150 include a single set of beam groups 150A, 150B, 150C, and 150D, and four beam groups in total are provided, as illustrated in FIG. 10A. The beam groups 150A, 150B, 150C, and 150D are arranged in that order in the axial direction of the photoconductor 62 (direction shown by arrow D). In FIG. 10A, the beam groups 150A, 150B, 150C, and 150D are drawn in a simplified manner.

The beam groups 150A, 150B, 150C, and 150D have the same structures as those of the grid 110 except the intervals between the beams 140 in the axial direction of the photoconductor 62 are larger than those in the beam groups 150A, 150B, 150C, and 150D of the grid 110. Accordingly, each beam 140 in the beam groups 150A, 150B, 150C, and 150D of the grid 210 connects the same thin lines 130 as those connected by the corresponding beam 140 in the beam groups 150A, 150B, 150C, and 150D of the grid 110.

Therefore, in the grid 210 according to the second modification, a single beam 140 is provided in each of the slits 128 between the thin lines 130, and the thin lines 130 that are next to each other are connected to each other by a single beam 140 at a single position. Thus, in the structure according to the second embodiment, the number of beams 140 is smaller than that in the grid 110, and the beams 140 are dispersed in the axial direction of the photoconductor 62.

Third Modification of Grid 110

Figure 11:
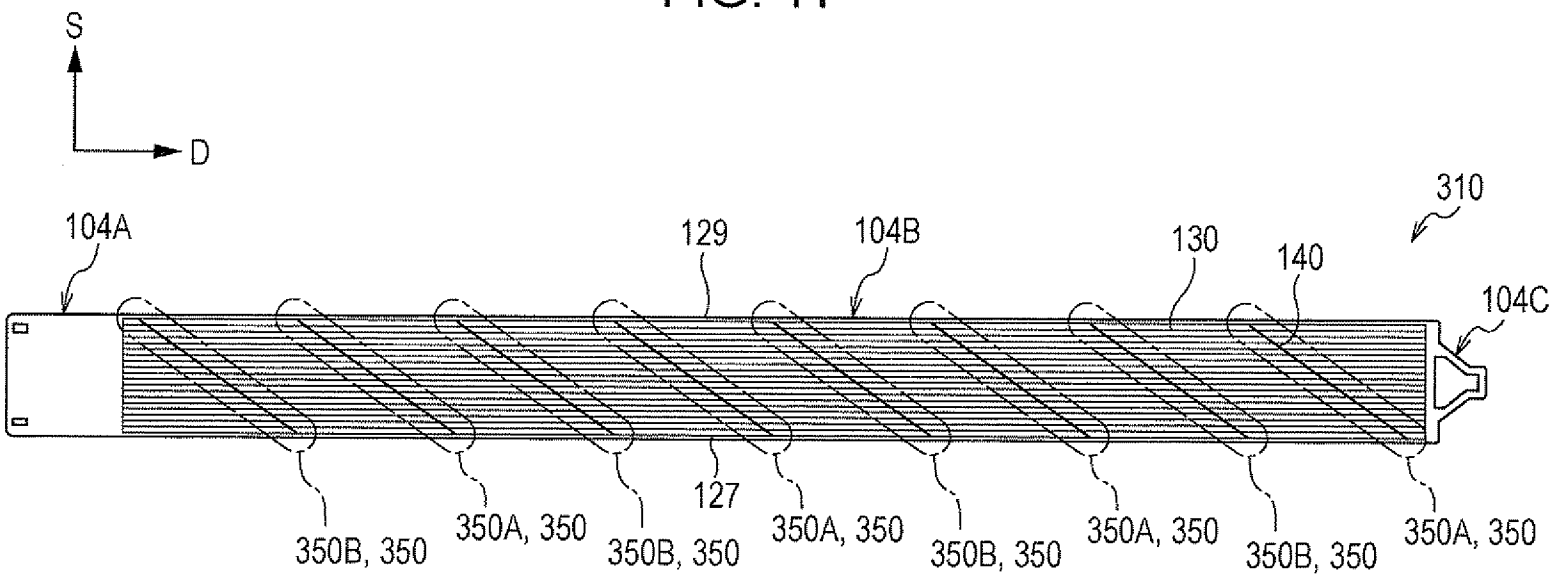
FIG. 11 is a plan view of a grid according to a third modification.

In the grid 110, the beam groups 150 include two sets of beam groups 150A, 150B, 150C, and 150D, and eight beam groups in total are provided. In contrast, in a grid 310 according to a third modification, beam groups 350 include four sets of beam groups 350A and 350B, and eight beam groups in total are provided, as illustrated in FIG. 11. The beam groups 350A and 350B are alternately arranged in that order in the axial direction of the photoconductor 62 (direction shown by arrow D). In FIG. 11, the beam groups 350A and 350B are drawn in a simplified manner.

In each of the beam groups 150A, 150B, 150C, and 150D of the grid 110, the beams 140 are arranged with three slits 128 disposed therebetween. In contrast, in each of the four sets of beam groups 350A and 350B in the grid 310, the beams 140 are arranged with a single slit 128 disposed therebetween.

Figure 12A:
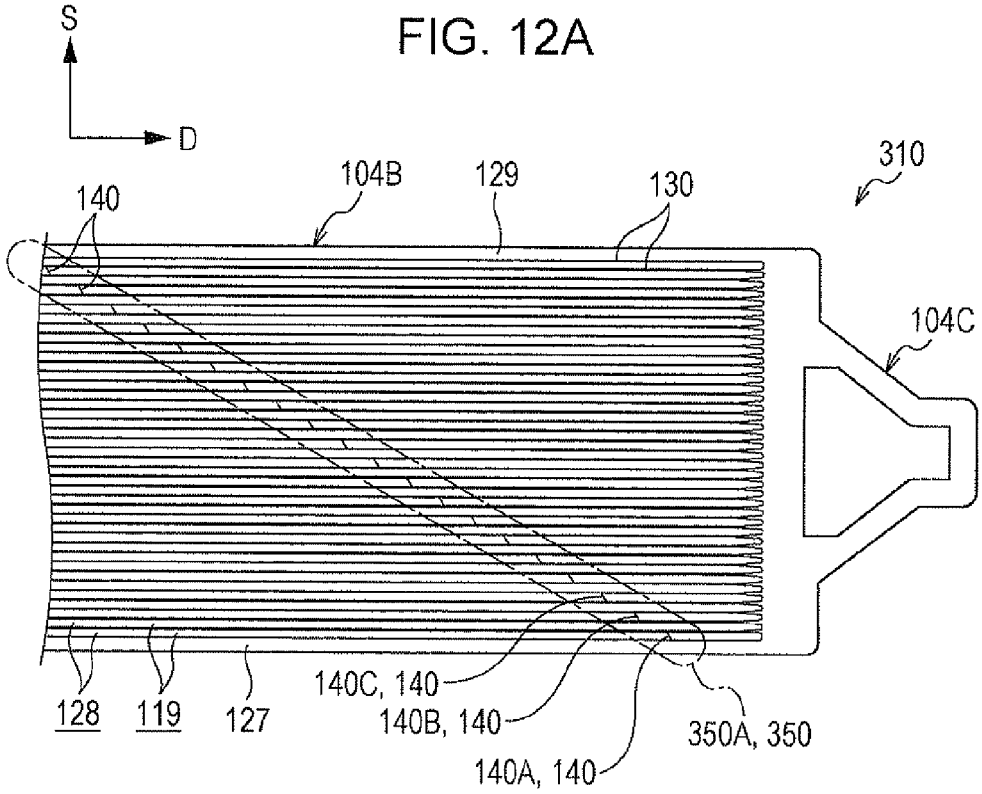
FIGS. 12A and 12B are enlarged partial plan views of the grid according to the third modification.

More specifically, in each of the four beam groups 350A, the first beam 140A from the bottom in FIG. 12A connects the linear portion 127 and the first thin line 130 from the bottom in FIG. 12A to each other. The second beam 140B skips a single slit 128 and connects the second and third thin lines 130 to each other. The third beam 140C skips a single slit 128 and connects the fourth and fifth thin lines 130 to each other. In this manner, the beams 140 connect two thin lines 130 to each other at positions where a single slit 128 is disposed between the beams 140. In FIG. 12A, only the beam group 350A closest to the attachment portion 104C is illustrated.

Figure 12B:
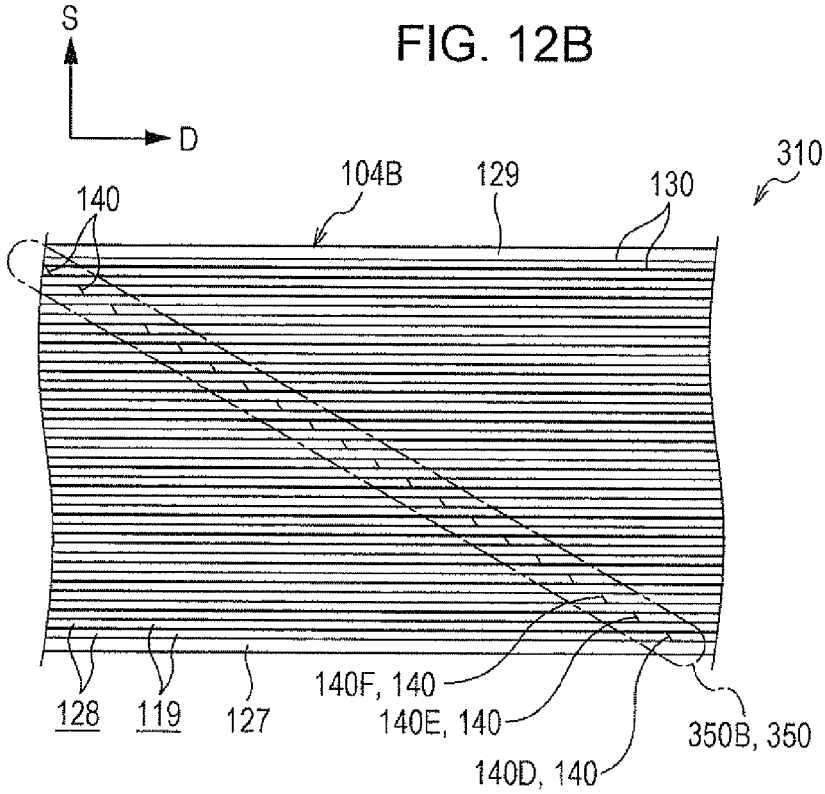

In each of the four beam groups 350B, the first beam 140D from the bottom in FIG. 12B connects the first and second thin lines 130 from the bottom in FIG. 12B to each other. The second beam 140E skips a single slit 128 and connects the third and fourth thin lines 130 to each other. The third beam 140F skips a single slit 128 and connects the fifth and sixth thin lines 130 to each other. In this manner, the beams 140 connect two thin lines 130 to each other at positions where a single slit 128 is disposed between the beams 140.

In the third modification, since the beams 140 are arranged in the above-described manner, four beams 140 are provided in each of the slits 128 between the thin lines 130, and the thin lines 130 that are next to each other are connected to each other by four beams 140 at four positions. According to the third modification, compared to the grid 110, the number of beams 140 is increased and the beams 140 are more densely arranged in the axial direction and the circumferential direction of the photoconductor 62.

Fourth Modification of Grid 110

Figure 13A:
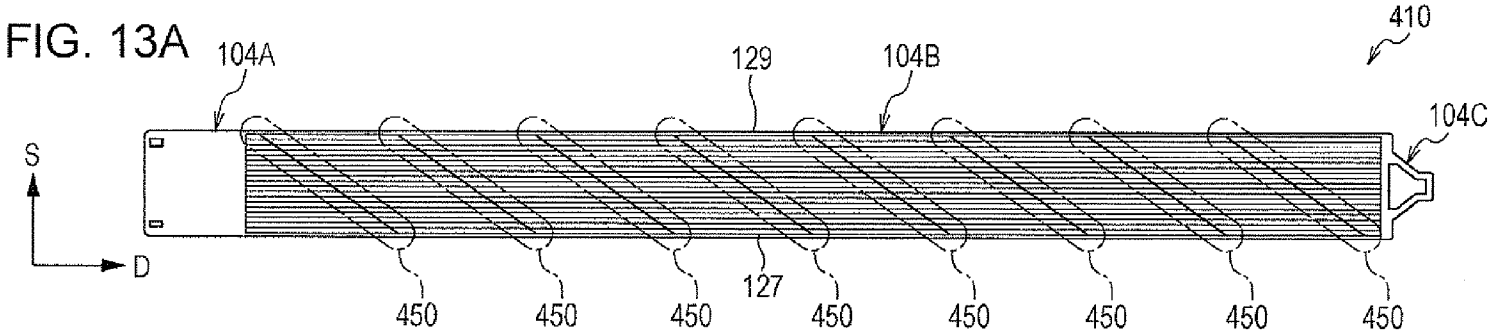
FIG. 13A is a plan view of a grid according to a fourth modification.

In the grid 110, the beam groups 150 include two sets of beam groups 150A, 150B, 150C, and 150D, and eight beam groups in total are provided. In contrast, in a grid 410 according to a fourth modification, eight beam groups 450 are provided, as illustrated in FIG. 13A. The beam groups 450 are arranged in the axial direction of the photoconductor 62 (direction shown by arrow D). In FIG. 13A, the beam groups 450 are drawn in a simplified manner.

In each of the beam groups 150A, 150B, 150C, and 150D of the grid 110, the beams 140 that are next to each other in the axial direction of the photoconductor 62 connect pairs of thin lines 130 that are all different from each other in the circumferential direction of the photoconductor 62. In contrast, in each beam group 450 of the grid 410, the beams 140 that are next to each other in the axial direction of the photoconductor 62 each connect two thin lines 130 to each other such that one of the two thin lines 130 is common between the beams 140 and the other one of the two thin lines 130 differs between the beams 140.

Figure 13B:
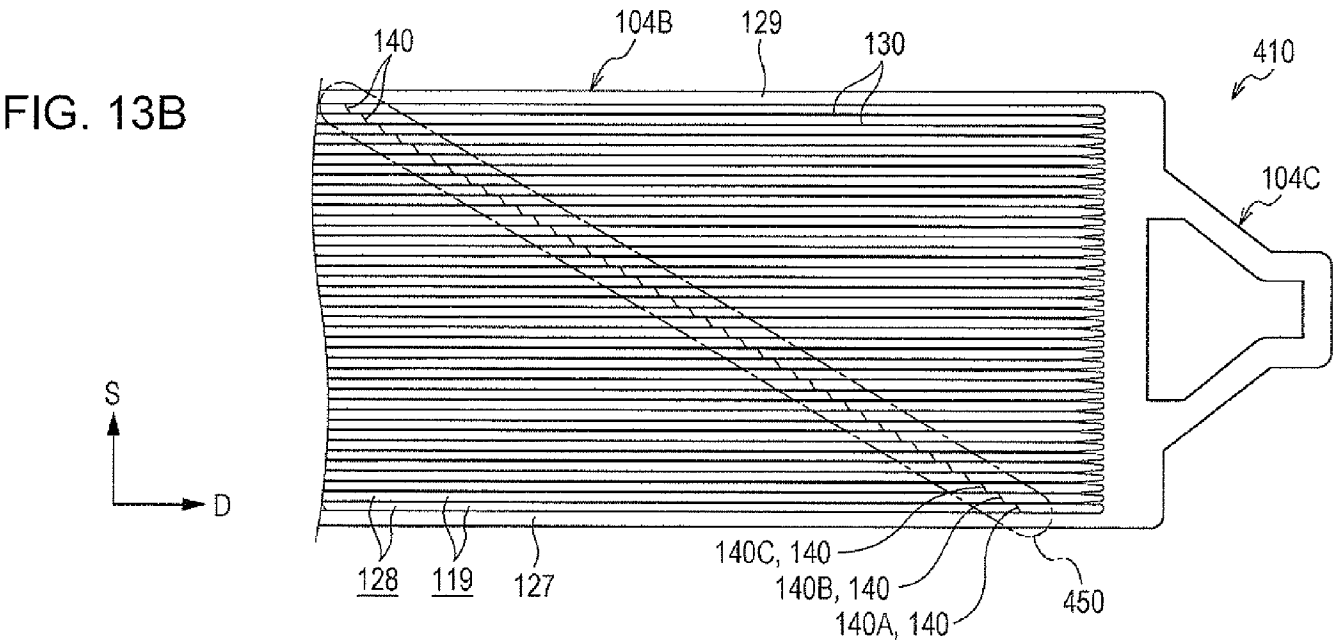
FIG. 13B is an enlarged partial plan view of the grid according to the fourth modification.

More specifically, in each beam group 450, the first beam 140A from the bottom in FIG. 13B connects the linear portion 127 and the first thin line 130 from the bottom in FIG. 13B to each other. The second beam 140B connects the first and second thin lines 130 to each other, and the third beam 140C connects the second and third thin lines 130 to each other. In this manner, the beams 140 connect two thin lines 130 to each other at positions shifted upward by a single slit 128 in FIG. 13B. In FIG. 13B, only the beam group 450 closest to the attachment portion 104C is illustrated.

In the fourth modification, since the beams 140 are arranged in the above-described manner, eight beams 140 are provided in each of the slits 128 between the thin lines 130, and the thin lines 130 that are next to each other are connected to each other by eight beams 140 at eight positions. According to the fourth modification, compared to the grid 110, the number of beams 140 is increased and the beams 140 are more densely arranged in the axial direction and the circumferential direction of the photoconductor 62.

Fifth Modification of Grid 110

Figure 14A:
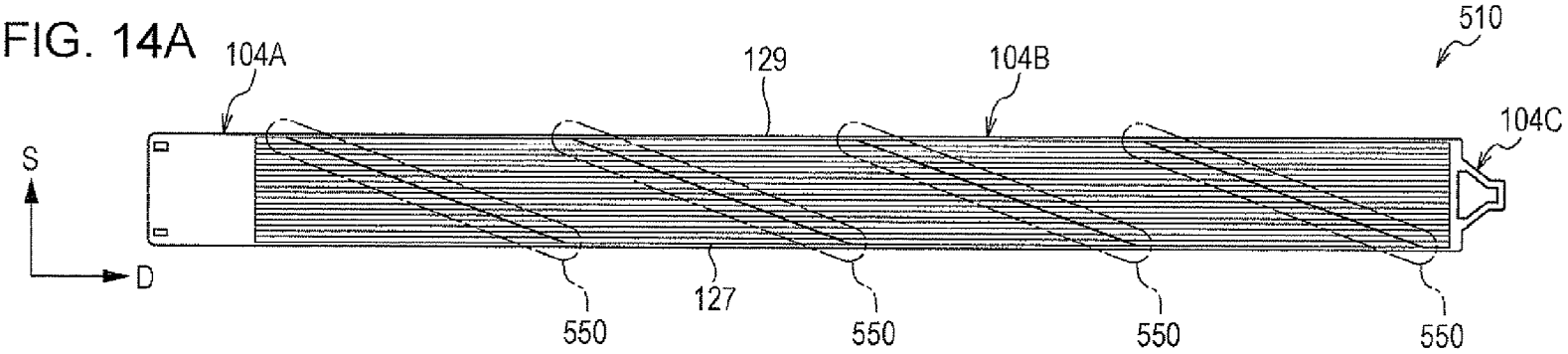
FIG. 14A is a plan view of a grid according to a fifth modification.

In the grid 110, the beam groups 150 include two sets of beam groups 150A, 150B, 150C, and 150D, and eight beam groups in total are provided. In contrast, in a grid 510 according to a fifth modification, four beam groups 550 are provided, as illustrated in FIG. 14A. The beam groups 550 are arranged in the axial direction of the photoconductor 62.

In each of the beam groups 150A, 150B, 150C, and 150D of the grid 110, the beams 140 that are next to each other in the axial direction of the photoconductor 62 connect pairs of thin lines 130 that are all different from each other in the circumferential direction of the photoconductor 62. In contrast, in each beam group 550 of the grid 510, the beams 140 that are next to each other in the axial direction of the photoconductor 62 each connect two thin lines 130 to each other such that one of the two thin lines 130 is common between the beams 140 and the other one of the two thin lines 130 differs between the beams 140.

Figure 14B:
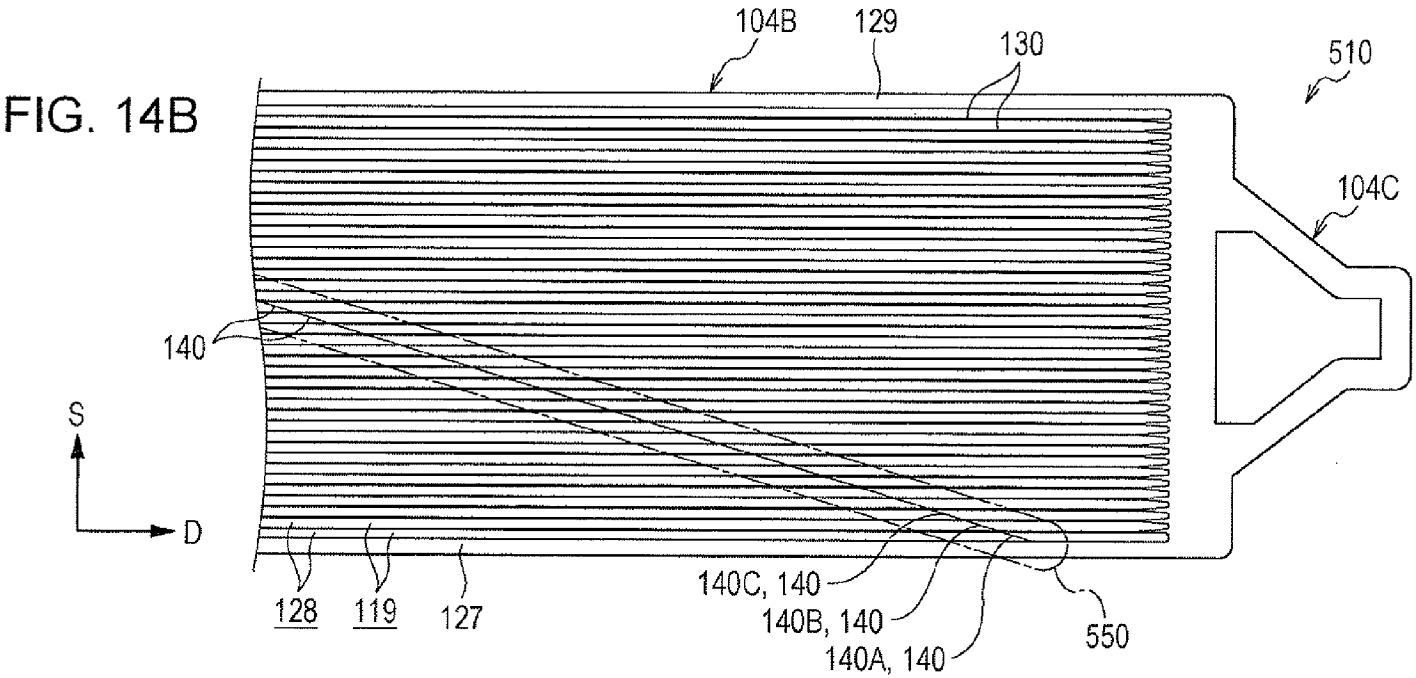
FIG. 14B is an enlarged partial plan view of the grid according to the fifth modification.

More specifically, in each beam group 550, the first beam 140A from the bottom in FIG. 14B connects the linear portion 127 and the first thin line 130 from the bottom in FIG. 14B to each other. The second beam 140B connects the first and second thin lines 130 to each other, and the third beam 140C connects the second and third thin lines 130 to each other. In this manner, the beams 140 connect two thin lines 130 to each other at positions shifted upward by a single slit 128 in FIG. 14B. In FIG. 14B, only the beam group 550 closest to the attachment portion 104C is illustrated.

In each of the beam groups 150A, 150B, 150C, and 150D of the grid 110, the beams 140 that are next to each other in the axial direction of the photoconductor 62 are arranged with an interval therebetween in the axial direction of the photoconductor 62. In contrast, in each of the beam groups 550 of the grid 510, the beams 140 that are next to each other in the axial direction of the photoconductor 62 are arranged along a straight line without an interval therebetween.

More specifically, for example, an end (left end in FIG. 14B) of the first beam 140A and an end (right end in FIG. 14B) of the second beam 140B are connected to each other at the same position on the first thin line 130 from the bottom in FIG. 14B, and the first and second beams 140A and 140B are arranged along a straight line. Accordingly, in each beam group 550, the beams 140 are arranged along a straight line that is oblique to the thin lines 130. The beams 140 are at an angle of, for example, 30 degrees with respect to the thin lines 130.

In the fifth modification, since the beams 140 are arranged in the above-described manner, four beams 140 are provided in each of the slits 128 between the thin lines 130, and the thin lines 130 that are next to each other are connected to each other by four beams 140 at four positions. According to the fifth modification, compared to the grid 110, the number of beams 140 is increased and the beams 140 are more densely arranged in the axial direction and the circumferential direction of the photoconductor 62.

Sixth Modification of Grid 110

In the grid 110, the beam groups 150 include four kinds of beam groups 150A, 150B, 150C, and 150D. In contrast, in a grid 610 according to a sixth modification, beam groups 650 include nine kinds of beam groups 650A, 650B, 650C, 650D, 650E, 650F, 650G, 650H, and 650I, as illustrated in FIG. 15.

In the beam groups 150A, 150B, 150C, and 150D of the grid 110, the beams 140 are arranged with three slits 128 disposed therebetween. In contrast, in the beam groups 650A, 650B, 650C, 650D, 650E, 650F, 650G, 650H, and 650I of the grid 610, the beams 140 are arranged with eight slits 128 disposed therebetween.

Figure 15:
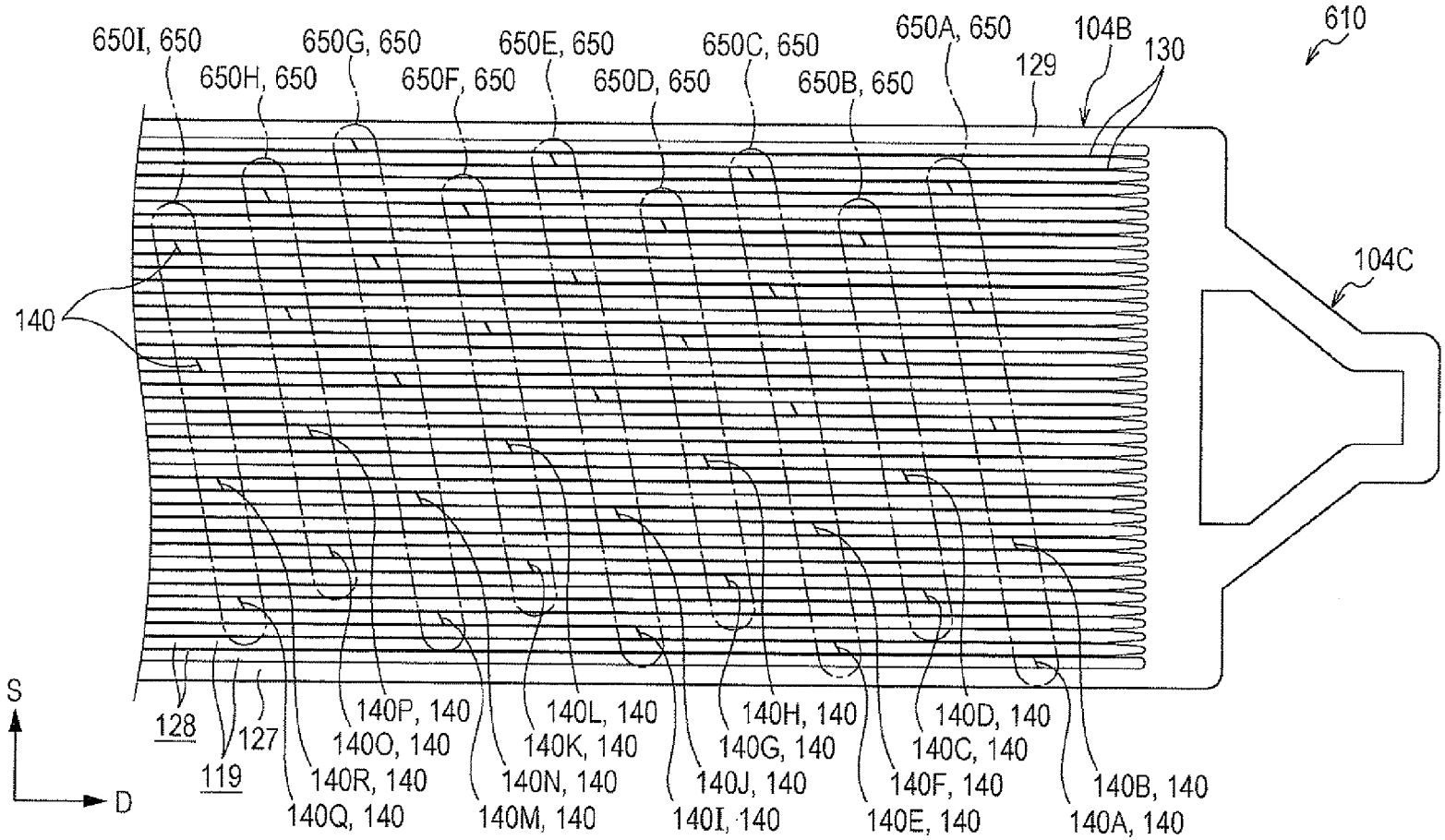
FIG. 15 is an enlarged partial plan view of a grid according to a sixth modification.

More specifically, in the beam group 650A, the first beam 140A from the bottom in FIG. 15 connects the linear portion 127 and the first thin line 130 from the bottom in FIG. 15 to each other. The second beam 140B skips eight slits 128 and connects the ninth and tenth thin lines 130 to each other. In this manner, the beams 140 connect two thin lines 130 to each other at positions where eight slits 128 are disposed between the beams 140.

In the beam group 650B, the first beam 140C from the bottom in FIG. 15 connects the fifth and sixth thin lines 130 from the bottom in FIG. 15 to each other. The second beam 140D skips eight slits 128 and connects the fourteenth and fifteenth thin lines 130 to each other. In this manner, the beams 140 connect two thin lines 130 to each other at positions where eight slits 128 are disposed between the beams 140.

In the beam group 650C, the first beam 140E from the bottom in FIG. 15 connects the first and second thin lines 130 from the bottom in FIG. 15 to each other. The second beam 140F skips eight slits 128 and connects the tenth and eleventh thin lines 130 to each other. In this manner, the beams 140 connect two thin lines 130 to each other at positions where eight slits 128 are disposed between the beams 140.

In the beam group 650D, the first beam 140G from the bottom in FIG. 15 connects the sixth and seventh thin lines 130 from the bottom in FIG. 15 to each other. The second beam 140H skips eight slits 128 and connects the fifteenth and sixteenth thin lines 130 to each other. In this manner, the beams 140 connect two thin lines 130 to each other at positions where eight slits 128 are disposed between the beams 140.

In the beam group 650E, the first beam 140I from the bottom in FIG. 15 connects the second and third thin lines 130 from the bottom in FIG. 15 to each other. The second beam 140J skips eight slits 128 and connects the eleventh and twelfth thin lines 130 to each other. In this manner, the beams 140 connect two thin lines 130 to each other at positions where eight slits 128 are disposed between the beams 140.

In the beam group 650F, the first beam 140K from the bottom in FIG. 15 connects the seventh and eighth thin lines 130 from the bottom in FIG. 15 to each other. The second beam 140L skips eight slits 128 and connects the sixteenth and seventeenth thin lines 130 to each other. In this manner, the beams 140 connect two thin lines 130 to each other at positions where eight slits 128 are disposed between the beams 140.

In the beam group 650G, the first beam 140M from the bottom in FIG. 15 connects the third and fourth thin lines 130 from the bottom in FIG. 15 to each other. The second beam 140N skips eight slits 128 and connects the twelfth and thirteenth thin lines 130 to each other. In this manner, the beams 140 connect two thin lines 130 to each other at positions where eight slits 128 are disposed between the beams 140.

In the beam group 650H, the first beam 140O from the bottom in FIG. 15 connects the eighth and ninth thin lines 130 from the bottom in FIG. 15 to each other. The second beam 140P skips eight slits 128 and connects the seventeenth and eighteenth thin lines 130 to each other. In this manner, the beams 140 connect two thin lines 130 to each other at positions where eight slits 128 are disposed between the beams 140.

In the beam group 650I, the first beam 140Q from the bottom in FIG. 15 connects the fourth and fifth thin lines 130 from the bottom in FIG. 15 to each other. The second beam 140R skips eight slits 128 and connects the thirteenth and fourteenth thin lines 130 to each other. In this manner, the beams 140 connect two thin lines 130 to each other at positions where eight slits 128 are disposed between the beams 140.

Although not illustrated, the beam groups 650A, 650B, 650C, 650D, 650E, 650F, 650G, 650H, and 650I are repeatedly arranged in that order in the axial direction of the photoconductor 62, and eight sets of beam groups 650A, 650B, 650C, 650D, 650E, 650F, 650G, 650H, and 650I are provided in the grid 610.

In the sixth modification, since the beams 140 are arranged in the above-described manner, eight beams 140 are provided in each of the slits 128 between the thin lines 130, and the thin lines 130 that are next to each other are connected to each other by eight beams 140 at eight positions. According to the sixth modification, compared to the grid 110, the number of beams 140 is increased and the beams 140 are more densely arranged in the axial direction and the circumferential direction of the photoconductor 62.

Seventh Modification of Grid 110

Figure 16A:
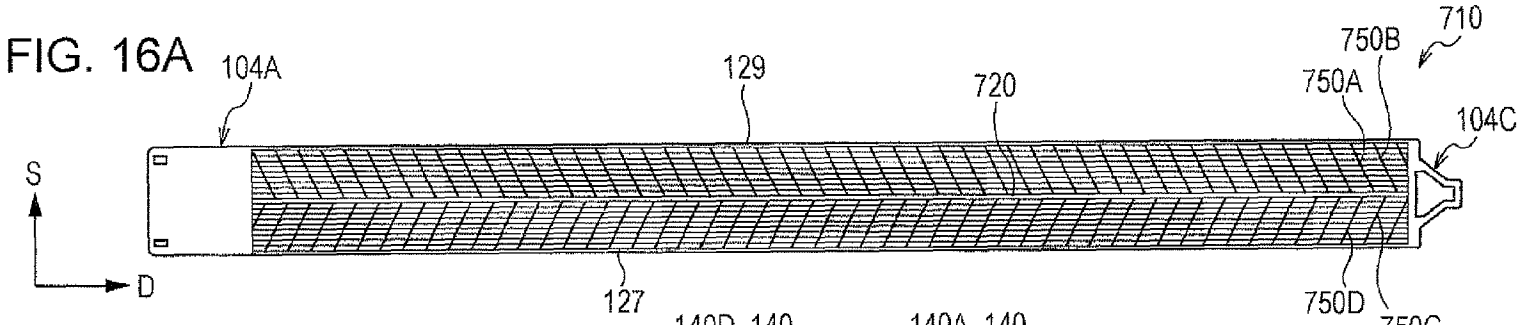
FIG. 16A is a plan view of a grid according to a seventh modification.
Figure 16B:
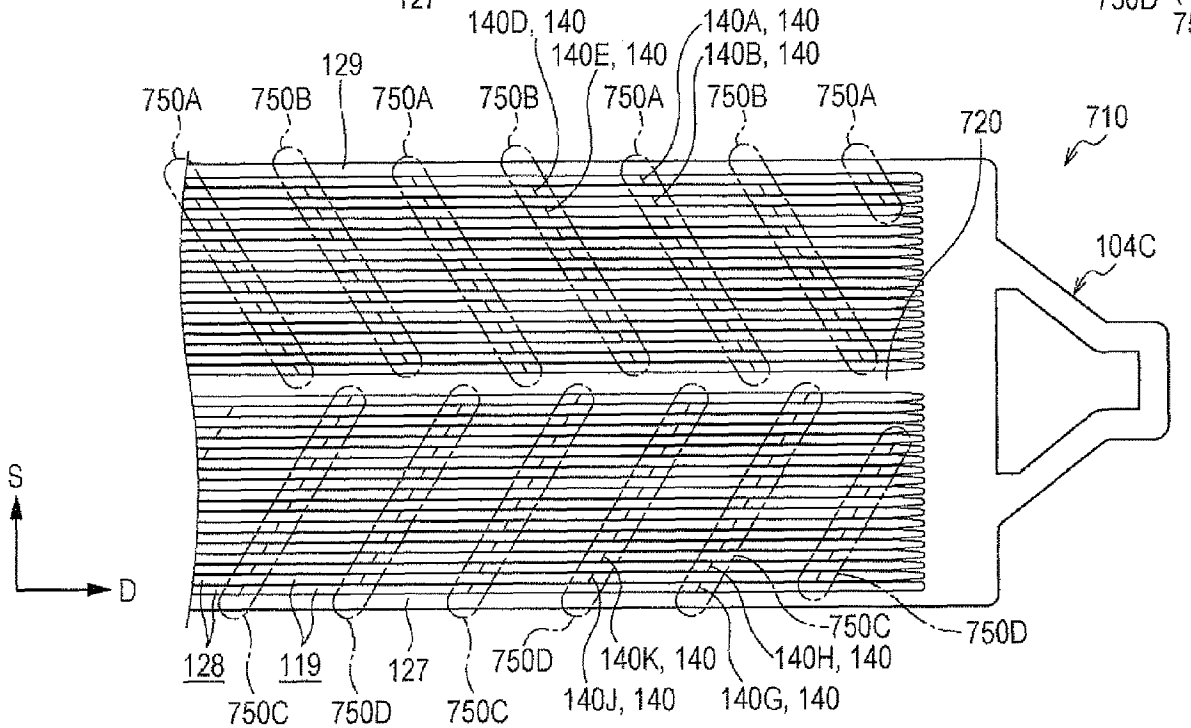
FIG. 16B is an enlarged partial plan view of the grid according to the seventh modification.

In a grid 710 according to a seventh modification, as illustrated in FIGS. 16A and 16B, a partitioning portion 720 is provided to section the electrode portion 104B at a central position thereof in the short-side direction of the grid 710 (direction shown by arrow S). Beam groups 750A and 750B are provided at one side (upper side in FIGS. 16A and 168) of the partitioning portion 720, and beam groups 750C and 750D are provided at the other side (lower side in FIGS. 16A and 16B) of the partitioning portion 720. The beam groups 750A and 750B are alternately arranged in that order in the axial direction of the photoconductor 62. The beam groups 750C and 750D are alternately arranged in that order in the axial direction of the photoconductor 62. In FIG. 16A, the beam groups 750A, 750B, 750C, and 750D are drawn in a simplified manner.

In the beam groups 750A, the first beam 140A from the top in FIG. 16B connects the linear portion 129 and the first thin line 130 from the top in FIG. 16B to each other. The second beam 140B skips a single slit 128 and connects the second and third thin lines 130 to each other. In this manner, the beams 140 connect two thin lines 130 to each other at positions where a single slit 128 is disposed between the beams 140.

In the beam groups 750B, the first beam 140D from the top in FIG. 16B connects the first and second thin lines 130 from the top in FIG. 16B to each other. The second beam 140E skips a single slit 128 and connects the third and fourth thin lines 130 to each other. In this manner, the beams 140 connect two thin lines 130 to each other at positions where a single slit 128 is disposed between the beams 140.

In the beam groups 750C, the first beam 140G from the bottom in FIG. 16B connects the linear portion 127 and the first thin line 130 from the bottom in FIG. 16B to each other. The second beam 140H skips a single slit 128 and connects the second and third thin lines 130 to each other. In this manner, the beams 140 connect two thin lines 130 to each other at positions where a single slit 128 is disposed between the beams 140.

In the beam groups 750D, the first beam 140J from the bottom in FIG. 16B connects the first and second thin lines 130 from the bottom in FIG. 16B to each other. The second beam 140K skips a single slit 128 and connects the third and fourth thin lines 130 to each other. In this manner, the beams 140 connect two thin lines 130 to each other at positions where a single slit 128 is disposed between the beams 140.

In the beam groups 750A and 750B, the beams 140 are shifted obliquely toward the attachment portion 1040 as the position thereof shifts from the linear portion 129 to the partitioning portion 720. In the beam groups 750C and 750D, the beams 140 are shifted obliquely toward the attachment portion 104C as the position thereof shifts from the linear portion 127 to the partitioning portion 720. Thus, the direction in which the beams 140 are arranged differs between the beam groups 750A and 750B disposed at one side of the partitioning portion 720 and the beam groups 750C and 750D disposed at the other side of the partitioning portion 720.

As described above, in the seventh modification, the direction in which the beams 140 are arranged differs between the beam groups 750A and 750B disposed at one side of the partitioning portion 720 and the beam groups 750C and 750D disposed at the other side of the partitioning portion 720. In this structure, the beam groups 750A and 750B and the beam groups 750C and 750D may be replaced by the beam groups 150 of the grid 110, the beam groups 350 of the grid 310, the beam groups 450 of the grid 410, the beam groups 550 of the grid 510, or the beam groups 650 of the grid 610. In the seventh modification, the partitioning portion 720 may be omitted.

Eighth Modification of Grid 110

Figure 17:
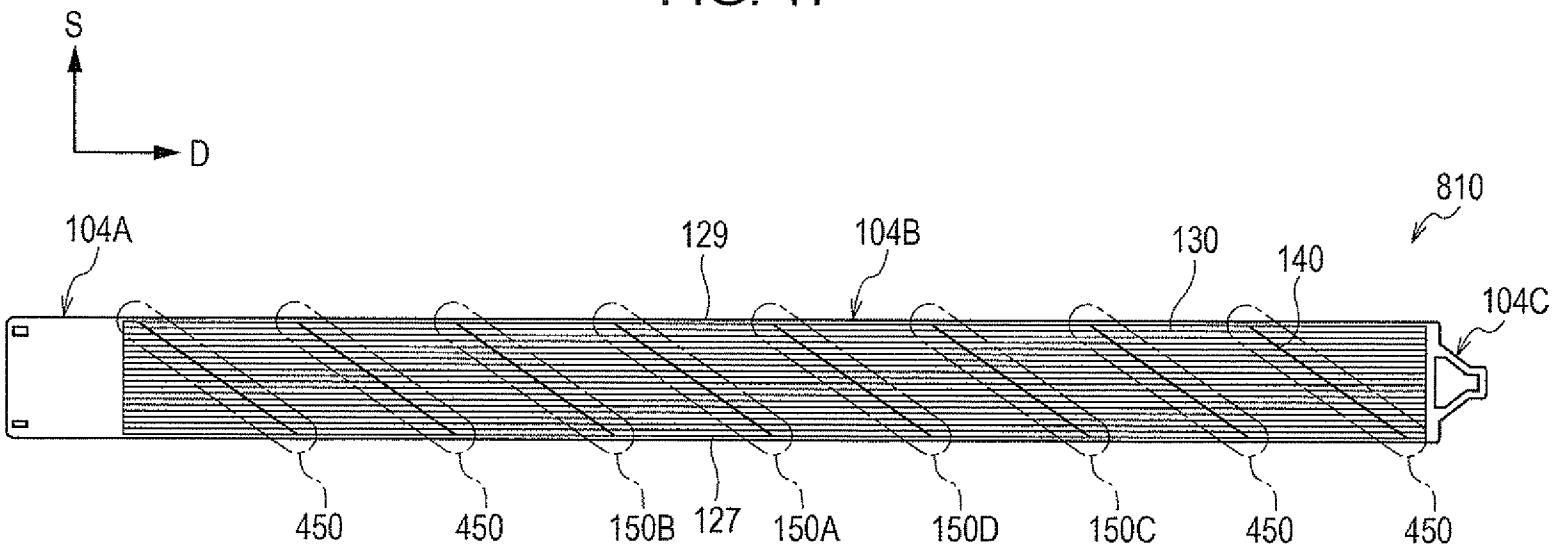
FIG. 17 is a plan view of a grid according to an eighth modification.

In a grid 810 according to an eighth modification, as illustrated in FIG. 17, the beam groups 450 according to the fourth modification are provided in place of the beam groups 150A and 150B near the attachment portion 1040 and the beam groups 150C and 150D near the attachment portion 104A in the grid 110. In FIG. 17, the beam groups 150A, 150B, 150C, 150D, and 450 are drawn in a simplified manner.

The number of beams 140 in the beam groups 150A, 150B, 150C, and 150D provided at a central area in the axial direction of the photoconductor 62 (direction shown by arrow D) is smaller than the number of beams 140 in the beam groups 450 provided at both ends in the axial direction of the photoconductor 62 (direction shown by arrow D). Accordingly, in the grid 810 according to the eighth modification, the density of the beams 140 is low in the central area in the axial direction of the photoconductor 62 (direction shown by arrow D).

Accordingly, in the case where the grid 810 is elastically deformed by force applied at both end portions thereof in the axial direction of the photoconductor 62 as in the present exemplary embodiment, the grid 810 may be evenly curved in the axial direction of the grid 810.

In the eighth modification, the number of beams 140 at a central area of the grid 810 is set to be lower than that at both ends in the axial direction of the photoconductor 62. However, as another way to reduce the density of the beams 140 in the central area of the grid 810 in the axial direction of the photoconductor 62, the thickness of the beams 140, for example, may be reduced in the central area of the grid 810 compared to that at both ends in the axial direction of the photoconductor 62. In addition, the density of the beams 140 may either be changed stepwise, as in the eighth modification, or gradually from the central area of the grid 810 toward both ends thereof in the axial direction of the photoconductor 62.

The present invention is not limited to the above-described exemplary embodiment, and various modifications, alterations, and improvements are possible. For example, the above-described modifications may be applied in combination. In addition, although the charging device 100 includes two discharge wires 106 and 108, the charging device 100 may include one discharge wire or three or more discharge wires.

In addition, although each beam 140 connects two thin lines 130 in the above-described exemplary embodiment and modifications, each beam 140 may connect three or more structural lines 127 to 129 and 130, the number of which is less than the total number of structural lines 127 to 129 and 130, that are next to each other in the circumferential direction of the photoconductor 62.

In the present exemplary embodiment, any beam 140 that is shifted from a certain beam 140 in the axial direction of the photoconductor 62 is defined as a beam 140 that is different from the certain beam 140. Therefore, the beams 140 that connect three or more structural lines 127 to 129 and 130, the number of which is less than the total number of structural lines 127 to 129 and 130, that are next to each other in the circumferential direction of the photoconductor 62 are limited to those which connect the thin lines 130 in a direction orthogonal to the thin lines 130. In the case where the beams 140 connect the structural lines 127 to 129 and 130 at an angle with respect to the structural lines 127 to 129 and 130, there may be a case in which it seems a single beam 140 connects three or more structural lines 127 to 129 and 130 that are next to each other in the circumferential direction of the photoconductor 62, as illustrated in FIG. 14B. However, in this case, a line that connects two of the structural lines 127 to 129 and 130 between the two structural lines 127 to 129 and 130 is defined as a single beam 140.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A charging device comprising:

a discharge electrode that extends along an axial direction of a member to be charged, the member to be charged having a cylindrical shape or a columnar shape; and a potential control plate that is disposed between the member to be charged and the discharge electrode and curved along a peripheral surface of the member to be charged, wherein the potential control plate includes three or more structural lines that are arranged in a circumferential direction of the member to be charged and that linearly extend along the axial direction of the member to be charged, and a plurality of connecting portions that are arranged in the axial direction of the member to be charged, each connecting portion connecting two or more of the three or more structural lines to each other, the two or more structural lines being next to each other in the circumferential direction of the member to be charged, wherein the structural lines connected by one of the plurality of connecting portions and the structural lines connected by another one of the plurality of connecting portions are at least partly different from each other.

2. The charging device according to claim 1, wherein each of the plurality of connecting portions connects only two of the three or more structural lines to each other, the two structural lines being next to each other in the circumferential direction of the member to be charged.

3. The charging device according to claim 1, wherein all of the structural lines connected by one of the plurality of connecting portions and the structural lines connected by another one of the plurality of connecting portions that is next to the one of the plurality of connecting portions in the axial direction of the member to be charged are different from each other.

4. The charging device according to claim 1, wherein, of the plurality of connecting portions, connecting portions that are next to each other in the axial direction of the member to be charged are arranged at a constant pitch in the circumferential direction of the member to be charged.

5. The charging device according to claim 1, wherein the potential control plate is elastically deformed so as to be curved along the peripheral surface of the member to be charged by a force applied to both end portions of the potential control plate in the axial direction of the member to be charged, and wherein the plurality of connecting portions are arranged at a lower density at a central area of the potential control plate than at both ends of the potential control plate in the axial direction of the member to be charged.

6. The charging device according to claim 1, further comprising:

a cleaning member that cleans the potential control plate, wherein the plurality of connecting portions are at an angle of substantially 20 degrees or more with respect to the structural lines.

7. The charging device according to claim 1, wherein the potential control plate is flat plate shaped when the potential control plate is not attached to the charging device, and is curved by a tension applying member and curve regulating members when the potential control plate is attached to the charging device, the tension applying member applying a tension to the potential control plate in the axial direction of the member to be charged, and the curve regulating members being provided at both ends of the potential control plate in the axial direction of the member to be charged.

8. The charging device according to claim 7, wherein the potential control plate maintains the curved shape by being interposed between the curve regulating members and curve maintaining members that face the curve regulating members.

9. An image forming apparatus comprising:

the charging device according to claim 1 and a photoconductor, the photoconductor being the member to be charged, and the photoconductor being charged by the charging device and having an overcoat layer.

10. A potential control plate comprising:

three or more structural lines that are arranged in a circumferential direction of a member to be charged and that linearly extend along an axial direction of the member to be charged, and a plurality of connecting portions that are arranged in the axial direction of the member to be charged, each connecting portion connecting two or more of the three or more structural lines to each other, the two or more structural lines being next to each other in the circumferential direction of the member to be charged, wherein the structural lines connected by one of the plurality of connecting portions and the structural lines connected by another one of the plurality of connecting portions are at least partly different from each other.

* * * * *